US005422431A

United States Patent [19]

Ichiki

[11] Patent Number: 5,422,431

[45] Date of Patent: Jun. 6, 1995

[54] ELECTRONIC MUSICAL TONE SYNTHESIZING APPARATUS GENERATING TONES WITH VARIABLE DECAY RATES

[75] Inventor: Tetsuji Ichiki, Hamamatsu, Japan

[73] Assignee: Yamaha Corporation, Japan

[21] Appl. No.: 22,331

[22] Filed: Feb. 24, 1993

[30] Foreign Application Priority Data

Feb. 27, 1992 [JP] Japan ..... 4-041760

[51] Int. Cl.[6] ..... G10H 1/057

[52] U.S. Cl. ..... 84/663; 84/702; 84/704

[58] Field of Search ..... 84/627, 628, 662, 663, 84/702–704, 737, 738

[56] References Cited

U.S. PATENT DOCUMENTS

| | | | |
|---|---|---|---|
| 3,465,088 | 9/1969 | Kohls | 84/702 |
| 3,516,321 | 6/1970 | Harris | 84/702 X |
| 3,562,400 | 2/1971 | Cutler | 84/702 |
| 3,848,142 | 11/1974 | Adachi | 84/702 X |
| 4,200,022 | 4/1980 | Carley et al. | 84/702 |
| 4,909,121 | 3/1990 | Usa et al. . | |

*Primary Examiner*—Stanley J. Witkowski
*Attorney, Agent, or Firm*—Graham & James

[57] ABSTRACT

An electronic musical tone synthesizing apparatus includes a damper pedal and an envelope generator. The envelope generator imparts an envelope to a musical tone to be produced. When the termination of the musical tone is designated, the envelope generator imparts a decaying envelope thereto. If the damper pedal is depressed during the processing of the decaying envelope, the decaying rate becomes slower. This leads to the performance of sustaining effects such as in an acoustic piano.

13 Claims, 17 Drawing Sheets

| STATE(2) | DEC | STATES | LEVEL | EQ&GT |
|---|---|---|---|---|
| 000 | 0 | KON ATTACK | 0000 | |
| 001 | 1 | DECAY 1 | L1 | |
| 010 | 2 | DECAY 2 | L2 | |
| 011 | 3 | SUSTAIN | 0000 | |
| 100 | 4 | KOFF RELEASE 1 | L4 | |
| 101 | 5 | KOFF RELEASE 2, WAITING CH | 0000 | |

| | | MASK | SUSFLG | SUSLVL |
|---|---|---|---|---|
| (a) | ① | 0 | 0 | |
| | ② | — | 0 | |
| | ③ | — | — | 0 |
| | ④ | — | — | — |
| (b) | ① | | 0 | |
| | ② | | — | 0 |
| | ③ | | — | — |
| (c) | ① | | | 0 |
| | ② | | | — |
| (d) | ① | | | |

FIG. 10

ELECTRONIC MUSICAL TONE SYNTHESIZING APPARATUS GENERATING TONES WITH VARIABLE DECAY RATES

BACKGROUND OF THE INVENTION

1. Field of the Invention

This invention relates in general to an electronic musical instrument, and relates in particular to an electronic musical instrument which is capable of producing a diminuendo effect of a musical tone similar to an acoustic musical instrument.

2. Technical Background of the Invention

In general, the generation of a musical tone in the keyboard type of electronic musical instruments is controlled through the control of the characteristics of the tone envelopes, by dividing a tone generation process into four regions or states: attack, decay, sustain and release states.

Therefore, when a key-release event is detected in conventional electronic instruments, and a key-off processing is ready to be initiated, the decay processing begins from the envelope level at the time when a key-off event has been detected, in accordance with the diminuendo envelope characteristics provided in the key-release processing.

Also, in the conventional tone synthesizing apparatus, the detailed processing steps for envelope waveform generation are carried out independently of those for the central processing control apparatus.

On the other hand, in an acoustic piano which is an acoustic musical instrument, damper pedals and sustaining pedals are used to achieve long lasting sound effects by pressing on the pedals to release the dampers pressing down the strings. Further, pressing on the pedals is effective even after the key-release event, because of the reverberation achieved by the effects of releasing the dampers. Such a technique is a favorite playing style.

In the conventional electronic musical instruments, when a key-off event is detected, the amplitude of an envelope waveform is decreased at a relatively large predetermined rate, and such a rate is maintained even if dampers and other devices are operated subsequently. These musical instruments, therefore, could not produce such reverberation effects as an acoustic musical instruments, and suffered from the serious deficiency in good musical expressions.

To overcome such a deficiency in the conventional electronic musical instruments, a technique is known of operating a damper pedal so as to provide a "resonance effect" to the process of generating a musical tone as disclosed in a U.S. Pat. No. 4,909,121. When a damper pedal is pressed in the instrument, a resonance tone is added to an ordinarily generated tone, thus generating a tone signal which includes the resonance tone. The resonance tone may be produced by passing an ordinary tone signal through a filter. Alternatively, data obtained by recording a tone actually reproduced on an acoustic piano, when a damper pedal is operated, may be stored in a memory and a resonance tone may be generated by reading out the stored date form the memory. The resonance tone signal may be sounded by itself or after mixing with an ordinary tone signal at a suitable mixing ratio.

SUMMARY OF THE INVENTION

The present invention was developed in the context of the technical background described above, and has an objective of presenting an electronic musical instrument to enable control over the waveforms of a musical tone to provide a wide range of reverberation effects during the decay state, similar to effects achievable on acoustic musical instruments.

The musical tone control apparatus of the present invention comprises:

(a) tone termination designating means for designating termination of the production of the musical tone;

(b) tone continuation means for designating continuation of the generation of the musical tone;

(c) envelope generation means for generating an envelope signal corresponding to the envelope waveform, wherein the envelope signal decreases at a first rate in response to the tone termination designating means, and when the tone continuation means designates continuation of the generation of the musical tone after the tone termination designating means is operated, the envelope signal decreases at a second rate in response to the tone continuation means, the second rate being smaller than the first rate.

The construction of the musical tone control apparatus of the present invention as presented above enables to express diminuendo and reverberation effects on an electronic musical instrument similar to those achievable on an acoustic musical instrument.

BRIEF DESCRIPTION OF THE DRAWINGS

FIG. 10 is an example of the relationships between the various envelope waveforms and the control signals therefor.

PREFERRED EMBODIMENTS OF THE INVENTION

A first embodiment of the present invention will be explained with reference to the figures provided.

Section A The Configuration

A-1 Overall configuration of the embodiment.

Figure 1:
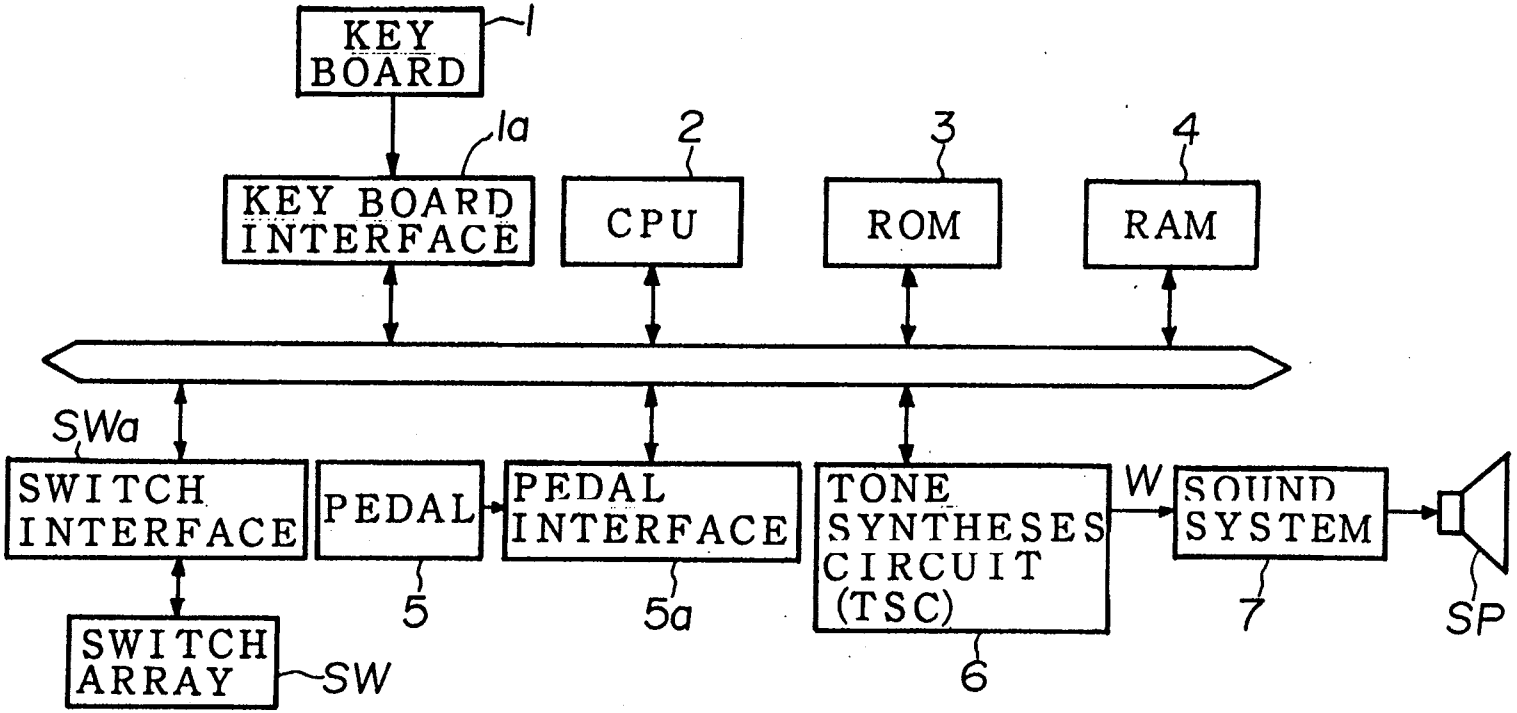
FIG. 1 is an overall block diagram of a tone generation apparatus of the present invention.

FIG. 1 shows a configuration of an electronic musical instrument (shortened to instrument hereinafter) of the embodiment of the present invention.

In this figure, the reference numeral 1*a* represents a key board interface, which scans the keyboard 1, and generates various (musical) information on the musical tones (shortened to tones), and forwards the information to a central processing unit CPU 2. The musical information comprises data concerning: a key code KC which represents a tone pitch for the corresponding key being depressed, key-on pulse KONP which represents the timing of key-depression, key-on signal KON which expresses the key-depression state and the key velocity KV.

Here, the key-on pulse KONP is a signal which becomes [1], at the instant of detection of key-on or key off processing of a key on the keyboard 1 within a given clock period, and thenafter becomes [0]. The key code KC contains data for the tone pitch corresponding to the key-on processing. The key-on signal KON is a signal which becomes [1] for the key-depression state and [0]for key-release state. The key velocity KV is data representing the speed at which the key is being depressed or released. The large KV value indicates a hard sound while a small KV value indicates a soft sound.

The reference numeral 3 is a ROM which stores various control programs and the associated data to be loaded into CPU 2.

RAM 4 is used to perform calculations for CPU 2, and is a temporary storage for data required for such computations.

A pedal 5 is provided on the instrument, and is used to provide similar effects as the pedal (sustaining and sostenuto pedals) provided on an acoustic piano. The pedal 5 generates signals concerning the degree and speed of a pedal operation action. The pedal interface 5*a* generates signals concerning such pedal actions as on-off actions of the pedal 5, and the pedal speed, based on the various signals supplied by the pedal 5.

A switch array SW, provided on such places as above the instrument, is used to define the tone and musical effects. For example, the LEVEL and RATE signals assume various values depending on the settings determined by the switch array SW, which outputs the data to CPU 2 through a switch interface SWa.

A tone synthesizing circuit (shorted to TSC) 6, is supplied with various operating data such as key-on pulse KONP, key velocity KV, key-on signal KON and key code from CPU 2, and performs various tone synthesis operations, and outputs a tone signal W in accordance with the data supplied thereto. Further, the TSC 6 constantly supplies CPU 2 with signals STATE, which will also be explained later. The configuration of TSC 6 will also be presented in detail later.

A sound system 7 performs various operations, such as filtering and digital to analogue (D/A) conversions, on the tone signal W. The analogue signal thus obtained is amplified and forwarded to speakers SP, which outputs the analogue signal from the sound system 7 as a sound.

A-2 Circuit Configuration of TSC 6

Figure 2:
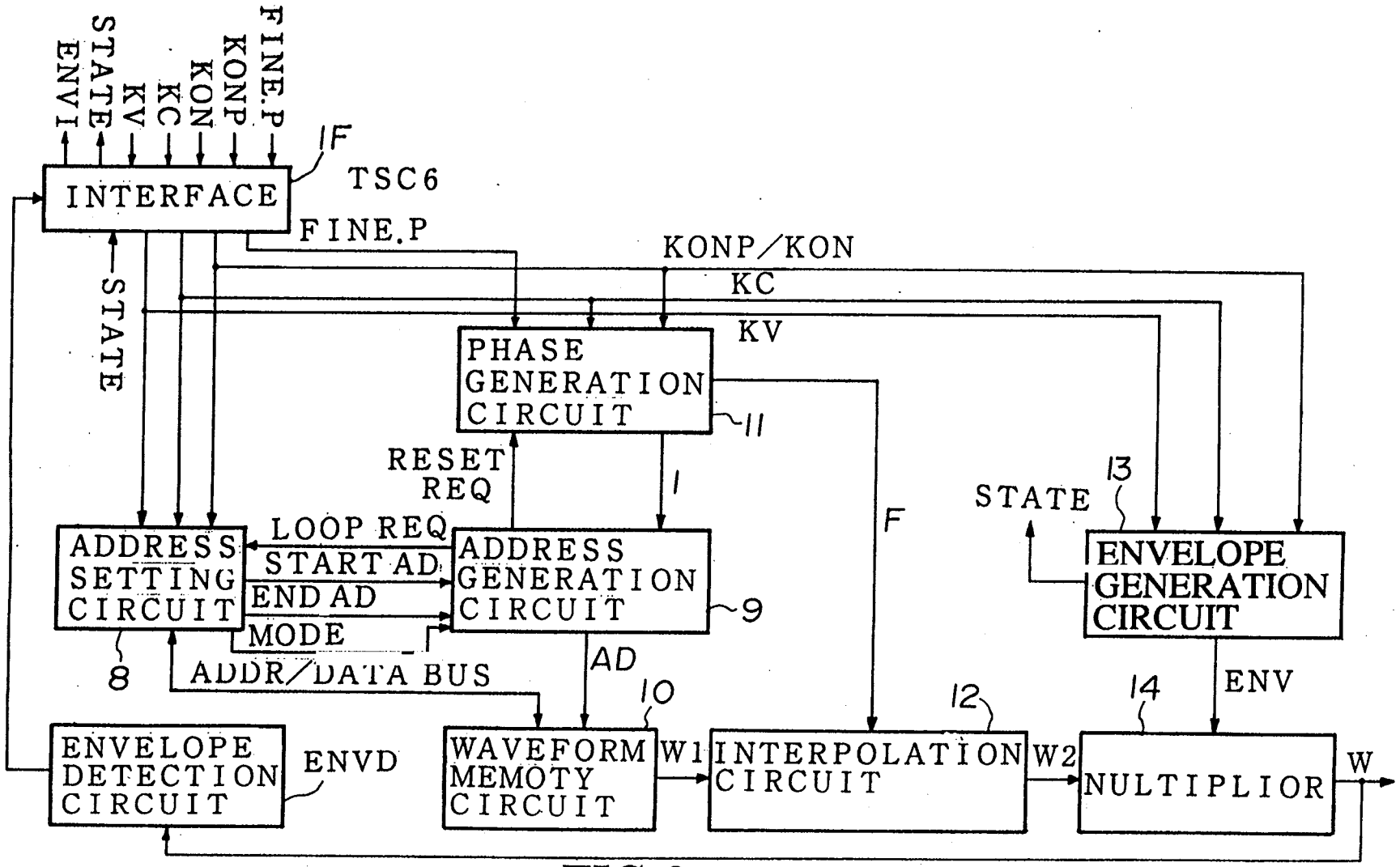
FIG. 2 is a block circuit diagram of the tone synthesis circuit, TSC 6 in an embodiment of the present invention.

A-2-1 Outline (FIG. 2)

The circuit configuration of TSC 6 will be explained with reference to FIG. 2. TSC 6 is provided with an interface IF, and the various tone data supplied by CPU 2 are supplied to the various sections of the TSC 6 after passing through the interface IF. Also, the various data outputted from the various sections of the circuit shown in FIG. 2 are supplied to CPU 2 through the interface IF. The operating data, such as the tone signal W and the envelope signal ENV, are generated by TSC 6 in accordance with the above mentioned various data. Each circuit will be explained separately below.

A-2-2 Waveform Memory Circuit 10

Figures 3A, 3B, 3C, 3D:
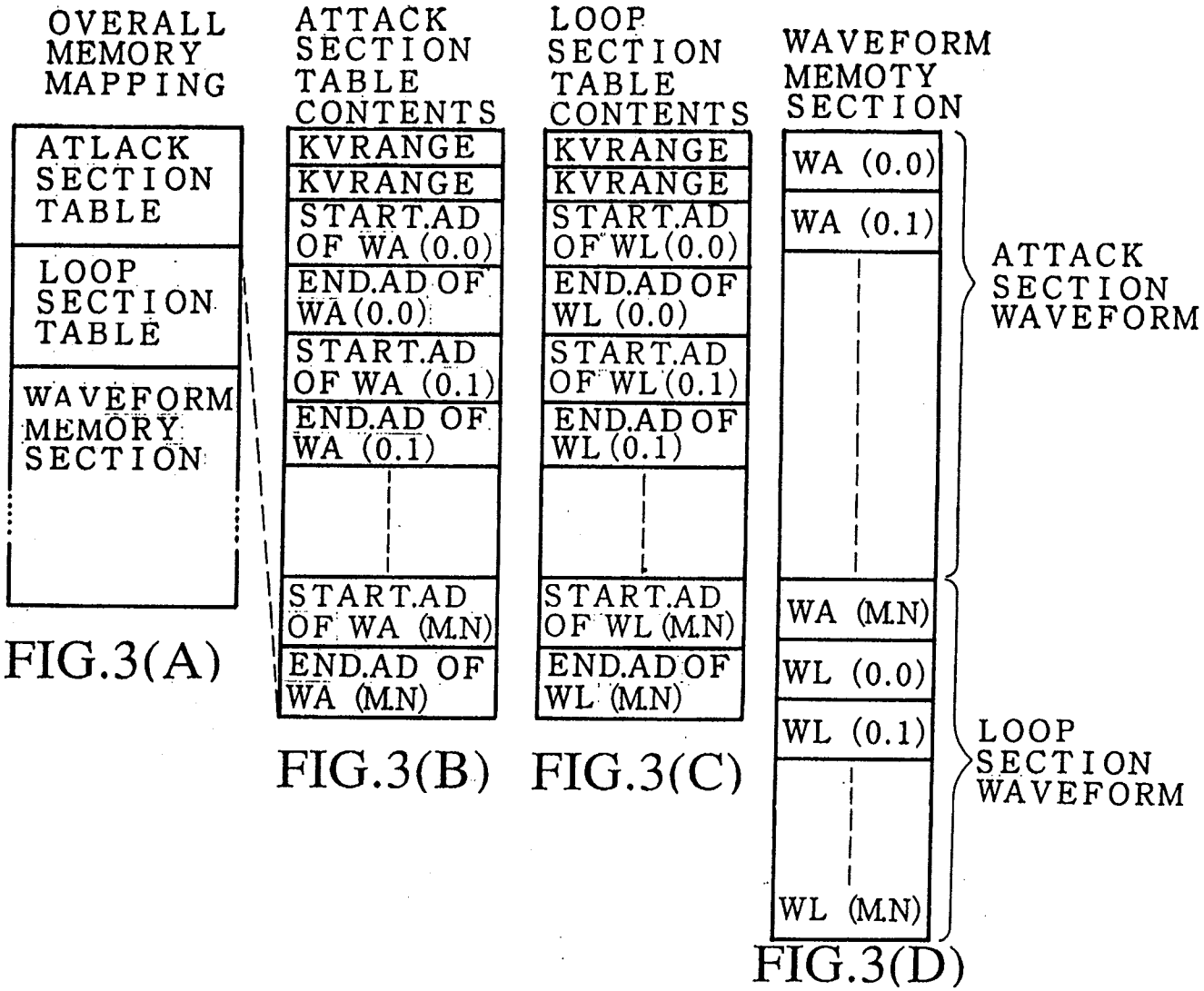
FIG. 3A–(D) are a memory mapping to illustrate the overall configuration of the waveform memory circuit 10.

First, the waveform memory circuit 10 stores waveforms for generating the tone signal W. The contents of the memories are shown in FIG. 3 (*a*) to (*d*). FIG. 3 (*a*) is a memory map showing the overall configuration of the waveform memory circuit 10, which consists of the ATTACK section table, LOOP section table and a waveform memory section. The waveform data stored in the waveform memory section shown in FIG. 3 (*d*) are divided into waveforms for attack section (waveforms corresponding to the initiation section of a tone) and the waveforms for loop section (waveforms which follow the initiation section and corresponds to the uniform section).

Next, the generation of a tone signal is performed by reading out a waveform in the attack section once, followed by repeated reading out of the waveform in the loop section. Many waveforms are stored in the attack and loop sections to correspond with the tone pitch and key-depression speed of various tones. In other words, as shown in FIG. 3 (*d*), there are attack waveforms WA (0, 0) to WA (M, N) stored in the attack waveform memory section, and the corresponding loop section waveforms WL (0, 0) to WL (M, N). In the description which follows, the memory region which stores the attack section waveforms is referred to as the attack section, and those which store the loop section waveforms as loop section.

Figure 4:
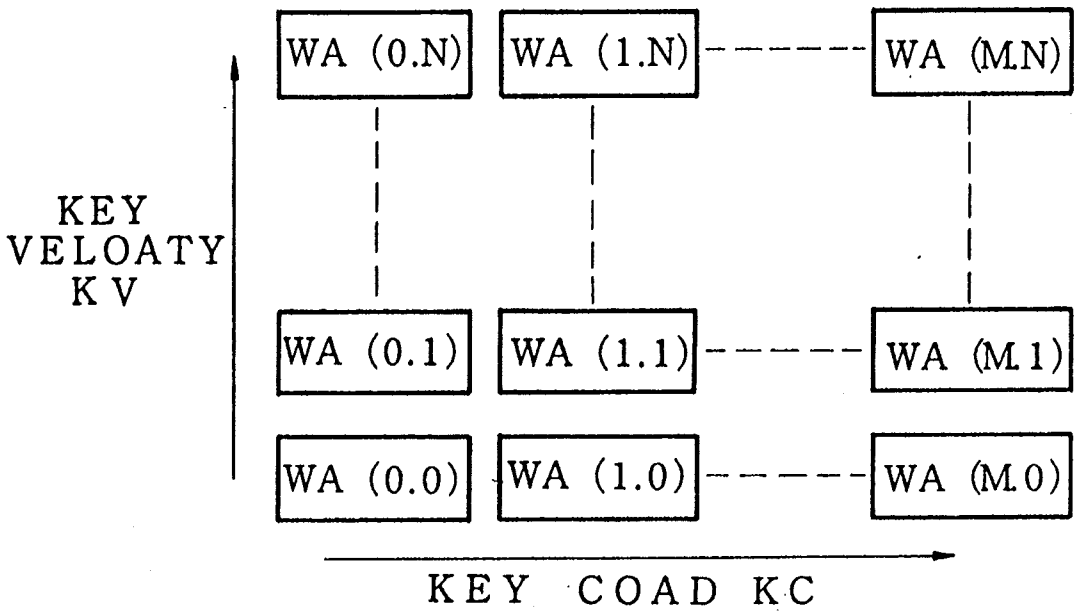
FIG. 4 is a diagram showing the relationship of the attack waveforms to the key-depression speed and to the key code which relates to tone pitch.

The relationships of the attack waveforms to the tone pitch and to the key-depression speed are as shown in FIG. 4. The waveforms are arranged on the X-axis in an ascending order, WA (0, 0), WA (1, 0) . . . WA (M, 0) and so on, as the tone pitch increases; and on the Y-axis, as WA (0, 0), WA (0, 1) . . . (0, L), as the key-depression speed increases. The relationships of the loop waveforms with the tone pitch and the key-depression speed are arranged in exactly the same manner.

The ATTACK section table, shown in FIG. 3 (*a*), contains address data for the attack section waveforms WA (X, Y), and their details are as shown in FIG. 3 (*b*). That is, the first address contains KV range data and the second address contains the KC range data while in the third address on down, they become paired addresses to contain the start address and the end address for the attack section waveforms. The KV range refers to a dynamic range of allowable values for the key velocity KV, and the KC range refers to the same for the key code KC.

The LOOP section table data are arranged in the same way, shown in FIG. 3 (*c*), as described for the data in the ATTACK section table.

A-2-3 Address setting circuit 8

Next, the address setting circuit 8 will be explained. The address setting circuit 8 determines the start address and the end address for the waveforms which are read out from the waveform memory circuit 10.

The operational steps are as follows: a key-on pulse KONP is supplied to the address setting circuit 8, which reads out the start address and the end address of waveforms in the attack section, corresponding to the key code KC and the key velocity KV, from the waveform memory circuit 10, and supplies the data as START-.AD and END.AD to the address generation circuit 9. The waveform readout processing is performed by setting the readout mode signal MODE to [0] for attack section waveforms, and to [1] for loop section waveforms.

When the attack section readout processing is completed, the address generation circuit 9 supplies a loop waveform request signal LOOP.REQ to the address setting circuit 8. The address setting circuit 8 reads out the start address and the end address corresponding to the key code KC and the key velocity KV from the waveform memory circuit 10, and supplies the data as START.AD and END.AD to the address generation circuit 9. The readout mode signal is set to [1].

A-2-4 Phase Generation Circuit 11

Upon receiving a key-on pulse KONP, the phase generation circuit 11 generates phase data corresponding to the key code KC. The phase data provide tone pitch information, i.e. relative readout addresses for the waveform data stored in the waveform memory circuit 10, and the phase data corresponding to the key code KC are successively summed (cumulative sum). The phase generation circuit 11 outputs: the integer part of the cumulative sum as a relative address integer part I; and the fractional part of the cumulative value as a relative address fraction part F.

The cumulative sum is reset by a reset request signal RESET.REQ outputted from the address generation circuit 9 which will be explained later. Supplemental value FINE.P supplements the relative readout address.

A-2-5 Address Generation Circuit 9

The address generation circuit 9 generates readout addresses for the waveform memory circuit 10. A readout address is generated by summing a START.AD signal supplied from the address setting circuit 8 with a relative readout address integer part I supplied from the phase generation circuit 11.

To read out an attack section waveform, the relative readout address integer part I is added successively to the START.AD signal (specifying the start address in the attack section), and the readout address AD thus obtained is supplied to the waveform memory circuit 10. When the readout address AD becomes equal to the END.AD signal (specifying the end address in the attack section), the address generation circuit 9 outputs a reset request signal RESET.REQ as well as outputting a loop waveform request signal LOOP.REQ.

When the signals RESET.REQ and LOOP.REQ are outputted, attack section start/end addresses for the RESET.REQ and LOOP.REQ are replaced newly with the loop start/end addresses.

Therefore, when reading out the loop waveforms, the relative readout address integer part I is successively added to a START.AD signal (specifying the address for loop section start), the readout address AD thus obtained is supplied to the waveform memory circuit 10. When the readout address AD becomes equal to the END.AD signal (specifying the loop section end address), the address generation circuit 9 outputs a reset request signal RESET.REQ as well as outputting a loop waveform request signal LOOP.REQ, and returns to the loop section start address, and begins generation of an address AD.

Subsequently, the generation of addresses for the loop section is continued (refer to FIG. 6), in accordance with the key-release or pedal-release operations, until the key-off signal KOFF becomes [1].

A waveform signal W1 (an output signal from the waveform memory circuit 10) is read out from the readout address AD (generated by the address generation circuit 9) and obtained by the steps described above.

A-2-6 Interpolation Circuit 12

The interpolation circuit 12 performs interpolation operations on the waveform signal W1 in terms of the relative readout address, fraction part F, and outputs a waveform W2 based thereon. This interpolation operation can be performed linearly on two neighboring data in accordance with the fraction part F, or polynomially by memorizing two or more waveform data.

A-2-7 Envelope Generation Circuit 13, Multiplier Circuit 14 and Envelope Detection Circuit ENVD The envelope generation circuit 13 generates envelope signals ENV according to a key-on pulse KONP supplied from the interface IF, key-on signal KON, key code KC and key velocity KV. It also outputs START signal (explained later).

The multiplier circuit 14 multiplies a waveform signal W2 outputted from the interpolation circuit 12 with the envelope signal ENV outputted from the envelope generation circuit 13, and forwards the resulting waveform signal W to the envelope detection circuit ENVD.

The envelope detection circuit ENVD performs filtering operations on the tone signal W, and yields an envelope signal expressing the maximum amplitude level at the time of tone generation. The tone signal thus generated is outputted as an envelope signal ENV1 to CPU 2 via the interface. IF. The envelope signal ENV is used for channel assignment control purposes, such as truncation processing.

In this case, the truncation processing refers to a processing to deal with a new key-depression state, when all the tone generation channels are occupied. In such a case, a tone generation channel is selected in which the value of the envelope ENV1 is the smallest, i.e. a channel in which the decay step has progressed furthest, and forcibly erases the data, and assigns the tone generated by the newly depressed key to the vacated channel.

A-3 Detailed Explanation of the Envelope Generation Circuit 13

A-3-1 Envelope Waveforms

The details of the envelope generation circuit 13 will be explained next.

Figures 7, 8:
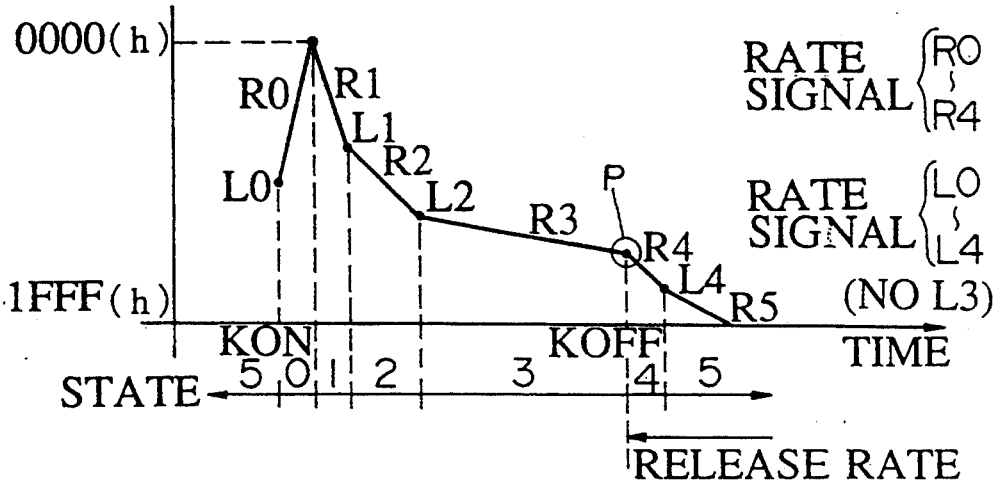
FIG. 7 is a typical envelope waveform in a tone generation processing.
FIG. 8 is an example of the states table.
Figure 9B:
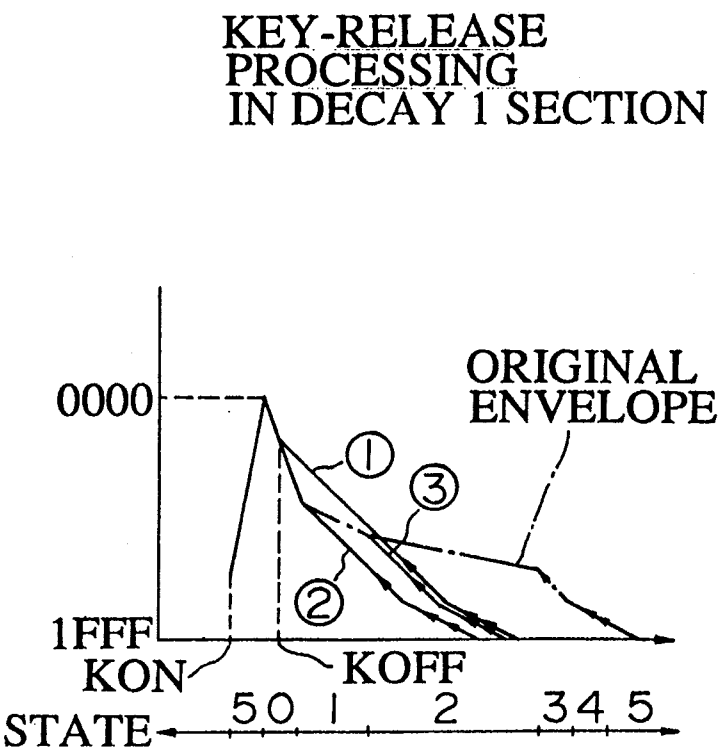
FIGS. 9(A)–(D) show various example of the envelope waveforms generated when a key-off event is detected during the various states.
Figure 9A:
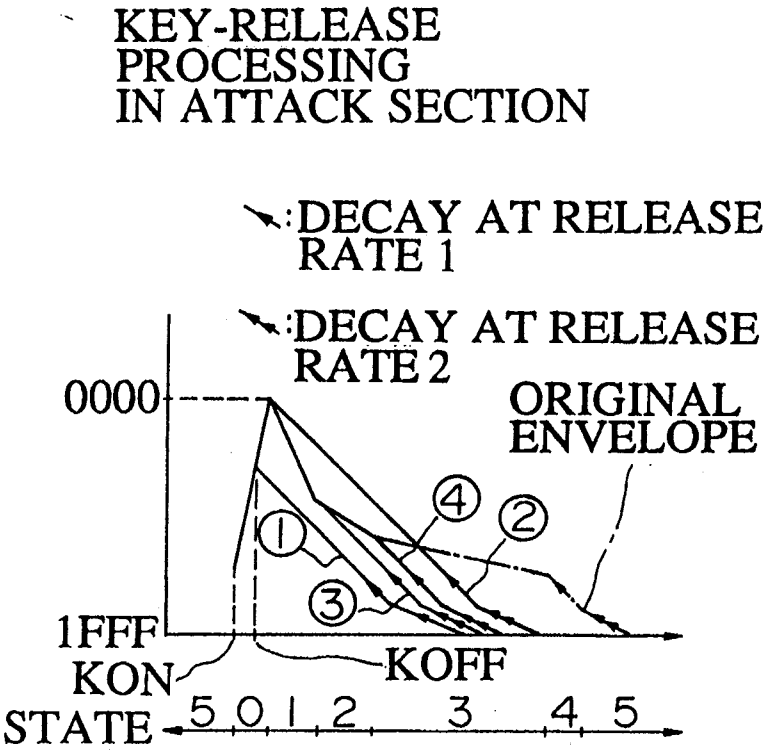
Figure 9D:
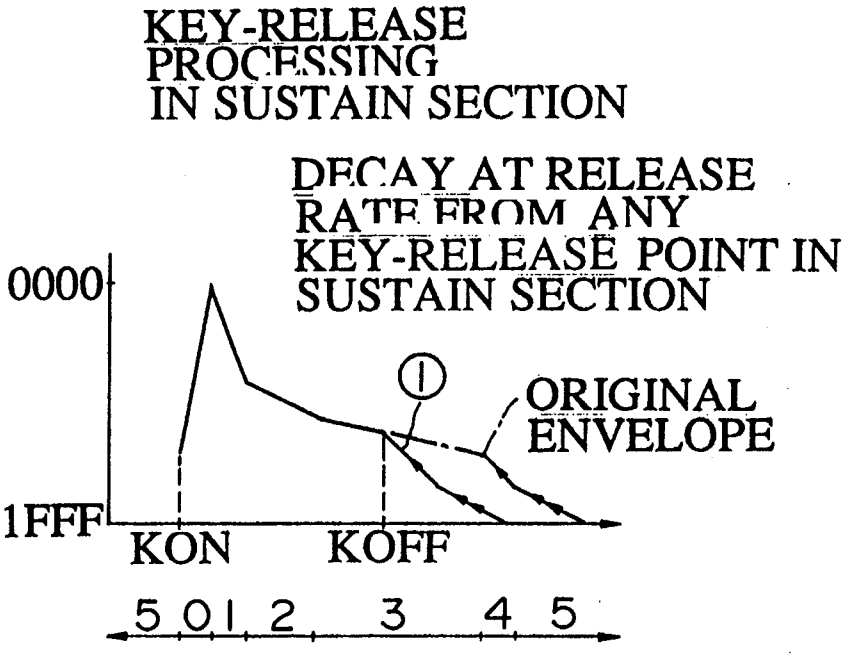
Figure 9C:
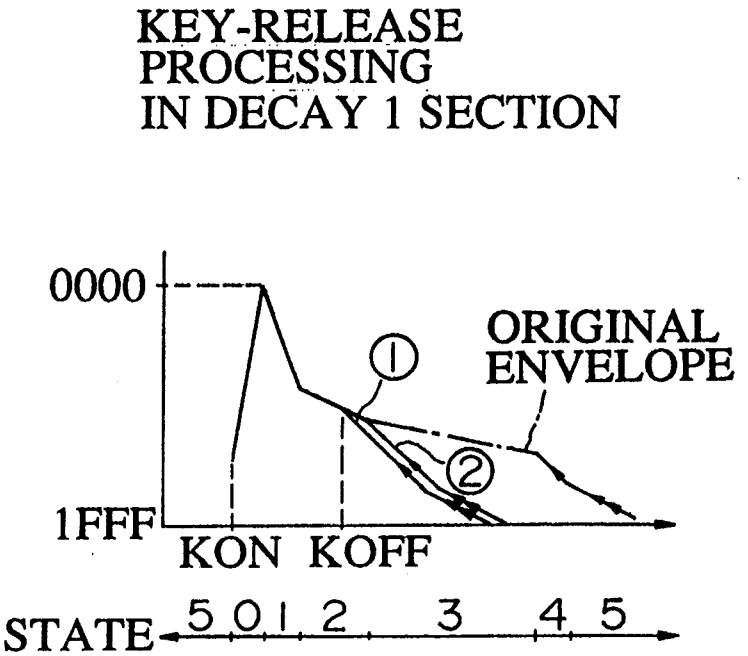

First, the envelope waveforms generated by the envelope generation circuit 13 will be explained with reference to FIGS. 7 and 8. An envelope signal is a time-dependent parameter as shown in FIG. 7, and its outline is governed by various signals such as LEVEL signal, RATE signal, key-on signal KON and key-off signal KOFF.

Figure 6:
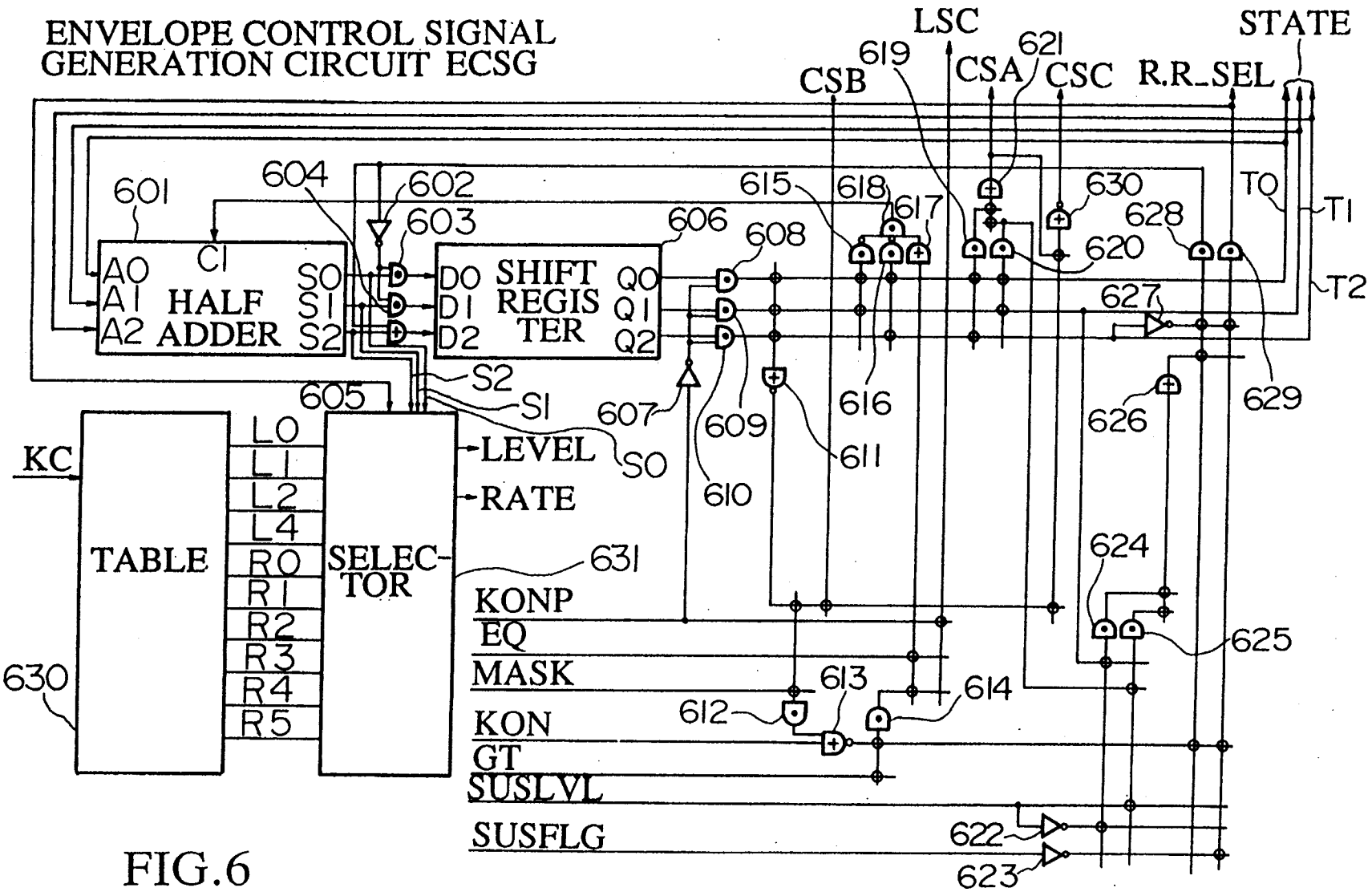
FIG. 6 is a schematic circuit diagram of the envelope control signal generation circuit ECSG.

The STATE signals express the states (attack, decay, sustain and release in a tone generation process) of an envelope, and as shown in FIG. 6, are parallel data made up of three bits consisting of TO (lowest bit), T1 (middle bit) and T2 (highest bit).

When a key-depression state is detected and a key-on pulse KONP becomes [1], STATE signal becomes [0] to indicate that the envelope is in the attack state. Thenafter, the STATE signal assumes one of the time-dependent signals [1] to [5] in accordance with the various tone information data supplied from CPU 2 via the data buses. The states of the envelope represented by the various STATE signals are: [1] is a decay 1 state; [2]

is a decay 2 state; [3] is a sustain state; [4] is a release 1 state; and [5] is a release 2 state. Here, the release 1 and release 2 states represent two finer division of a release state, as are decay 1 and decay 2 states. In the following explanations, "release state" is an inclusive term which includes release 1 and release 2 states.

The LEVEL signals shown in FIG. 8 represent the relevant target envelope values and opening values of the envelope waveforms of the state expressed by the STATE signal, at the time of a key-depression processing detection. The LEVEL signal is determined: by the value of L0, the initiation value for an envelope waveform during the key-on KON event; by the value of L1–L2, the target values, during the decay state, in which the target envelope value [000(h)] is given by signals other than the LEVEL signal. In practical terms, the target envelope values are chosen so that for a STATE signal [1] the LEVEL signal is [L1]; for a STATE signal [2] the LEVEL signal is [L2]; and for a STATE signal [4] the LEVEL signal is [L4]. When a key-depression processing is detected and the key-on pulse changes from [0] to [1], the envelope generation process begins by setting the envelope start signal at [L0] as shown in FIG. 7.

When the STATE signal assumes a value of either [0], [3] or [5], the target envelope values are not given by the LEVEL signals, but are determined by internal logic. That is, for a STATE signal [0] the target envelope value is [0000(h)]; for a STATE signals [3] and [5] the target envelope value is [1FFF(h)].

An example of the RATE signal shown in FIG. 8 represents the changes in the envelope signal variation with respect to time, (i.e. the slope of an envelope). For example, consider a case of a tone generation represented by the steps, "subsequent to the key-depression processing, the envelope state becomes a sustain state, and the key-release processing is performed"; in such a case, the RATE signals will vary as follows: in the attack state the RATE signal is [R0], in the decay 1 state the RATE signal is [R1], in the decay 2 state the RATE signal is [R2], in the sustain state the RATE signal is [R3], in the release 2 state the RATE signal is [R5] (refer to FIG. 7). In FIG. 7, [R0] is termed the attack rate, [R1] the decay 1 rate, [R2] the decay 2 rate, [R3] the sustain rate, [R4] the release 1 rate, [R5] the release 2 rate. Here, the release 1 and release 2 rates are fine divisions of a release rate, as are decay 1 and decay 2 rates. In the following explanations, "release rate" includes both the release 1 and release 2 rates.

Further, STATE signals and LEVEL signals are related singularly, but STATE signals and RATE signals do not relate singularly. The envelope waveform shown in FIG. 7 represents a case of a tone generation in which, "subsequent to the key-depression processing, the envelope state (STATE signal) becomes a sustain state, and the key-release processing is performed" at a point P indicated in this figure. The rate signal and the state signal are both altered by the key-off event. Therefore, if "during either an attack state or a decay state, the key-release processing is performed", the values of the RATE signals are set so as to be consistent with the play conditions existing regardless of the STATE signal. Therefore, in the following explanations, it should be kept in mind that a release state signifies a decreasing state of a signal at a release rate, and is not directly related to a STATE signal.

Also, in FIG. 8, it will be noted the "EQ & GT" column is void. This is because GT and EQ signals are envelope control signals and are, therefore, dependent on the manner of playing a tone. This will be explained later in more detail with examples.

A-3-2 Practical Configuration of Envelope Generation Circuit 13

A-3-2-1 Outline of Envelope Generation Circuit 13

Figure 5:
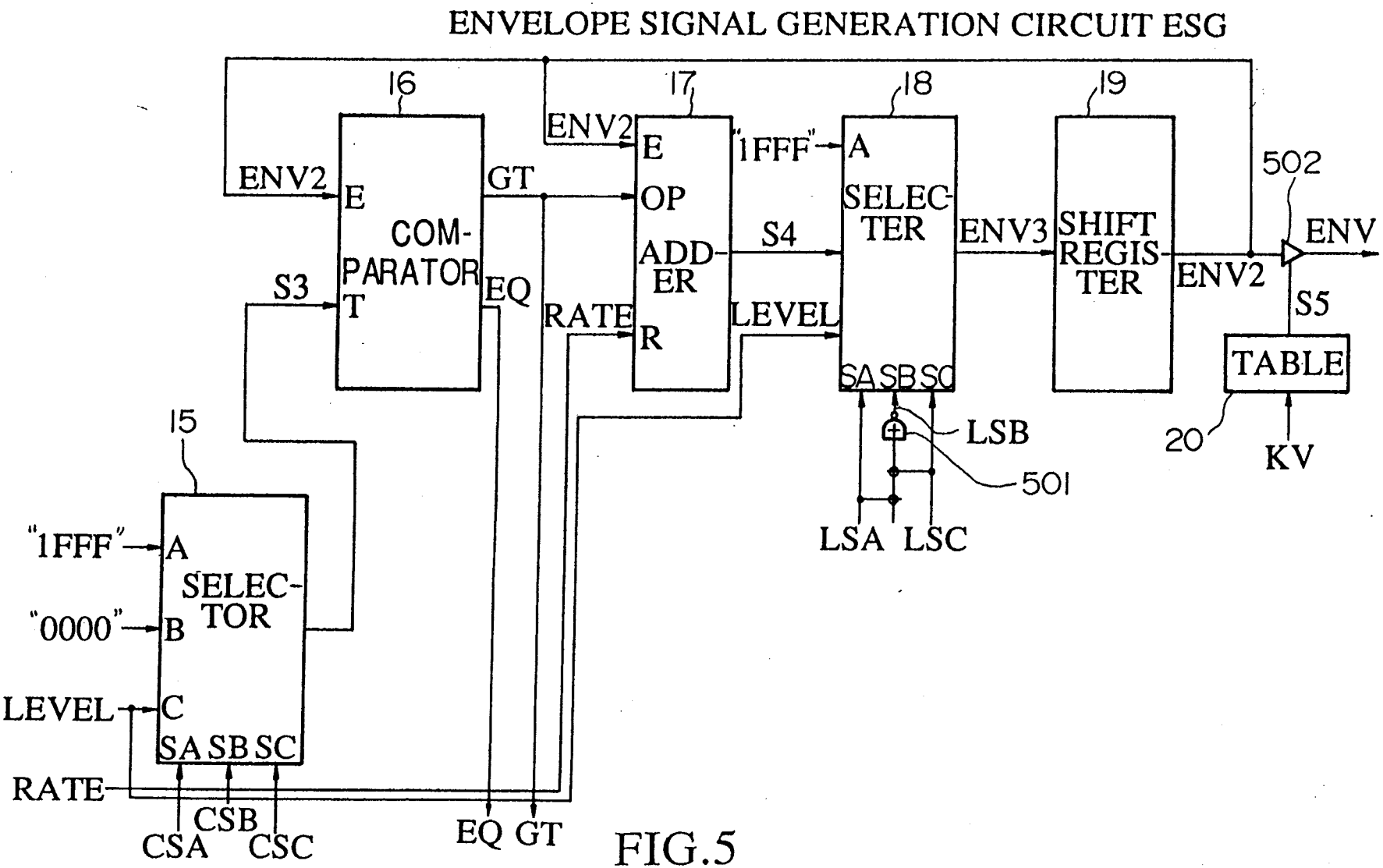
FIG. 5 is a block circuit diagram of the envelope signal generation circuit ESG.

The envelope generation circuit 13 (refer to FIG. 2) includes the envelope signal generation circuit ESG shown in FIG. 5 and the envelope control signal generation circuit ECSG shown in FIG. 6. In FIG. 5, S3 is a target envelope value; S4 is an initial envelope value; ENV3 is an envelope signal; ENV2 is a present envelope value; ENV is an envelope signal; and S5 is an envelope output signal level control value.

The envelope generation circuit 13 sets the dynamic range of the envelope signal ENV in accordance with the key velocity KV, and sets the values to be assigned to the LEVEL and RATE signals in accordance with the key code KC. The key-on pulse KONP, the key-on signal KON and the key-off signal KOFF are used to control the timing of start-up/end of the envelope waveforms (refer to KON and KOFF in FIG. 7). However, the signal value of a key-off signal KOFF is determined in terms of a key-on signal KON by the internal logic circuits in the envelope control signal generation circuit ECSG shown in FIG. 6.

A-3-2-2 Outline of the Configuration of the Envelope Control Signal Generation Circuit ECSG (refer to FIG. 6)

The envelope control signal generation circuit ECSG generates envelope control signals to control the envelope signal generation circuit ESG in accordance with the signals, such as the key code KC, supplied from the interface IF. The envelope control signals generated include control signals CSA, CSB and CSC which are control signals for selecting the target envelope values S3 in the selector 15 (refer to FIG. 5). Other control signals generated are LSA and LSC; and LSC, together with LSA which is supplied from an interface (not shown), is used to set the values of the envelope signal ENV3 to be outputted to the shift register 19.

The detailed configuration of this circuit will be explained later.

A-3-2-3 The Configuration of the Envelope Signal Generation Circuit ESG (refer to FIG. 5)

The selector 15 sets the values of a target envelope value S3 in a state represented by a STATE signal (refer to LEVEL signals in FIGS. 7 & 8). As shown in FIG. 5, when a control signal CSA supplied to the terminal SA is [1], an input signal [1FFF(h)] inputted into the input terminal A is set to be the target envelope value S3, (the STATE signal becomes a value signifying either a sustain or a waiting state by circuit operation). When a control signal CSB supplied to the terminal SB is [1], an input signal [0000(h)] inputted into the input terminal B is set to be the target envelope value S3, (the STATE signal becomes the attack state by circuit operation). When a control signal CSC supplied to the terminal SC is [1], an input signal value (L0 to L2 or L4) set in the LEVEL signal at the input terminal C becomes the target envelope value S3. (The STATE signal becomes a value signifying either a decay or a release 1 state by circuit operation).

Next, the comparator 16 outputs a control signal GT to the adder 17, and control signals EQ and GT to the envelope control signal generation circuit ECSG (refer to FIG. 6). The comparator 16 compares a present envelope value ENV2 inputted into the input terminal E with the target envelope value S3 inputted into the input terminal T.

As a result of this comparison, the values shown below are set in the control signals GT and EQ, and are outputted to the adder 17.

| | |
|---|---|
| Case 1. | if S3 < ENV2, then<br>GT = 1, EQ = 0 |
| Case 2. | if S3 = ENV2, then<br>GT = 0, EQ = 1 |
| Case 3. | if S3 > ENV2, then<br>GT = 0, EQ = 0 |

The adder 17 computes a starting value which will become an initial envelope value for the envelope signal ENV in the tone generation state and outputs the value to the selector 18 as the initial envelope signal S4.

Depending on the value of the signal GT supplied to the control terminal OP, the initial envelope signal S4 are set as follows.

| | |
|---|---|
| Case 4. | if GT = 1, then<br>S4 = ENV2 − RATE |
| Case 5. | if GT = 0, then<br>S4 = ENV2 + RATE |

Case 4 corresponds to an attack state envelope and Case 5 corresponds to all the envelopes in other states. It follows that Case 1 corresponds to an attack state, and the Cases 2 & 3 correspond to all the envelopes in other states.

Next, the selector 18 selects a signal to determine the values of the envelope signal ENV of a tone in the waiting state or in the generation state, and outputs the signal as an envelope signal ENV3 to the shift register 19. In this case, the values of the envelope signal ENV3 are determined in accordance with the values of the control terminals SA, SB and SC as shown below.

| | |
|---|---|
| Case 6. | SA = 1, SB = 0, SC = 0 (waiting state)<br>ENV3 = 1FFF(h) (input to terminal A) |
| Case 7. | SA = 0, SB = 1, SC = 0 (sounding state)<br>ENV3 = S4 |
| Case 8. | SA = 0, SB = 0, SC = 1 (key-depression detection state)<br>ENV3 = LEVEL (= L0) |

The values of the envelope signal ENV3 are held in the shift register 19, and are returned to the comparator 16 and the adder 17.. Case 6 corresponds to a case of the control signal LSA being [1], Case 7 corresponds to a case of both control signals LSA and LSC being [0] and Case 8 corresponds to a case of the control signal LSC being [1]. The NOR-gate 501 is a dual input NOR-gate, and the input signals are a control signal LSA and a control signal LSC which is generated by the key-on pulse KONP.

Next, the shift register 19 holds the supplied envelope signal ENV3 for one clock period, and returns it (the envelope signal ENV3) to the comparator 16 as the present envelope value ENV2. The multiplier 502 multiplies the present envelope value ENV2 with the envelope signal output level control value S5 (which is outputted from Table 20 in accordance with the key velocity KV), and outputs the result as an envelope signal ENV. The envelope signal ENV becomes the output value of the envelope generation circuit 13, and is supplied to the multiplier circuit 14 (refer to FIG. 2).

A-3-3 Various Control Signals in the Envelope Generation Circuit 13 (Refer to FIGS. 5 & 6)

A-3-3-1 MASK Signal (Refer to FIGS. 6, 9 and 10)

The MASK signal operates when a key-release processing is detected and determines whether or not to set the key-off signal KOFF as [1] after ending the attack state.

In practical terms, when the MASK signal is [1], even if the key-release processing is detected in the attack state, key-off signal KOFF is maintained as [0], and the key-off signal KOFF is set to [1] starting "from the time of ending the attack state". In other words, depending on the value of the MASK signal, the timing between the actual key-release processing and the start-up of the key-off signal KOFF can be shifted.

A-3-3-2 SUSFLG Signal (refer to FIGS. 6, 9 and 10)

The SUSFLG signal operates when the envelope state is either attack state or decay state, i.e. the state signal STATE is [0], [1] or [2]. The function is explained in the following.

In the attack state and when the MASK signal is set to [0], the SUSFLG signal decides whether the decay should proceed at the release rate starting from the time of detection of the key-release processing. In practice, when a key-release processing is detected and SUSFLG signal is set to [0] in the attack state, the envelope waveform "decays immediately from the then-existing envelope level at the release rate". This condition is depicted in FIG. 9 (*a*), Curve 1. If the MASK signal is [1], the envelope waveform takes the shape shown in FIG. 9 (*a*), Curve 2.

Next, in the decay state, the SUSFLG signal decides -whether the decay state should proceed at the release rate from the time of detection of the key-release processing or from the time of key-release state. In practice, when the SUSFLG signal is set to [0] in the decay state and when a key-release processing or key-release state is detected, the envelope waveform "decays immediately from the then-existing envelope level at the release rate". This condition is depicted by Curve 1 in FIGS. 9 (*b*) and (*c*).

A-3-3-3 SUSLVL Signal

The SUSLVL signal operates when the envelope state is in the decay 2 state, i.e. when the STATE signal is [2]. The function of this signal is to decide whether to set the output signal from the OR-gate 626 to [1] in the decay 2 state. In practice, when the SUSLVL signal is [0], the output signal from the OR-gate 626 becomes [1]in the decay 2 state, and when the SUSLVL signal is [1], the output signal from the OR-gate 626 is [0].

The SUSLVL signal operates when the key-release processing is detected in the decay 2 state and the SUSFLG signal is set to [1]. In this case, the signal does not decay immediately from the then-existing envelope level at the release rate, but decays from the time of ending the decay 2 state. This is shown by a curve 2 in FIG. 9 (*c*).

A-3-3-4 Other Operations

The RR_SEL signal (refer to FIG. 6) is supplied to the selector 631, and when this signal is set to [1], the CPU2 forces the selector 631 to select a release rate. The selection of the release rate is made in reference to the then-existing envelope signal ENV. If the envelope signal ENV is less than [L4], the release 1 rate is chosen while if the envelope signal ENV is more than [L4], the release 2 rate is chosen (refer to FIG. 7).

The functions of the key code KC, key-on pulse KONP, EQ signal, key-on signal KON, GT signal, LEVEL signal and RATE signal are the same as described earlier.

A-3-4 Envelope Control Signal Generation Circuit ECSG (Refer to FIG. 6)

Various functions of the envelope control signal generation circuit ECSG shown in FIG. 6 will be explained in the following.

First, when the control terminal CI becomes [1], the half adder 601 adds [001(b)] to the lowest input terminal A0 of the three-bit input terminals, A0, A1, and A2, and outputs the result from the three-bit output terminals, SO (lowest), S1 (middle) and S2 (highest). Here, all such three-bit signals are generalized by a term signal ST. Further, the overflows generated in the adding operations in the highest bit S2 are discarded. The inverter 602 receives an output signal from the AND-gate 628, inverts the signal and outputs the inverted signal to the AND-gate 603 and AND-gate 604.

The AND-gates 603, 604 and OR-gate 605 are logic arrays for controlling the signal values to be supplied to the shift register 606. Each of the AND-gates 603, 604 multiplies the output values, from the output terminals SO and S1 of the adder 601, with the value obtained by passing the output signal of the AND-gate 628 through the inverter 602, and outputs the logical products, respectively, to the input terminals D0, D1 of the shift register 606. The OR-gate 605 inputs the logical sum of the output values from the AND-gate 628 and the output terminal S2 into the input terminal D2 of the shift register 606.

The shift register 606 holds a signal ST for one clock period in the input terminals DO (lowest), D1 (middle) and D2 (highest), and outputs the off-phase values of the signal ST from the three-bit output terminals, Q0 (lowest), Q1 (middle) and Q2 (highest).

The table 630 provides the reference table for determining the various signal values to be outputted to the selector 631 in accordance with the key code signals KC supplied by the interface IF (shown in FIG. 2). The selector 631 selects the values (from the table 630) to be assigned to LEVEL signal and RATE signal in accordance with the values of the RR_SEL signal and GT signal. When the RR_SEL is [1], the value to be set in the RATE signal is determined from the release rate (R4 or R5) regardless of the values of the signal ST.

The inverter 607 outputs the inverted value of the key-on pulse KONP to the AND-gates 608, 609 and 610, each of which multiplies the output values, from the output terminals Q0 and Q1 of the shift register 606, with the output value of the inverter 607, and outputs the logical products, respectively, as signals TO (lowest), T1 (middle) and T2 (highest). The three-bit signal constitute a STATE signal in an envelope.

The NOR-gate 611 outputs the negative logical sum of the AND-gates 608, 609 and 610 as a control signal CSB. The AND-gate 612 outputs the logical product between the output value of the NOR-gate 611 and the MASK signal. The NOR-gate 613 outputs the negative logical sum of the AND-gate 612 output value and key-on signal KON as the key-off signal KOFF. The above logic is adopted so that even if the key-release processing is detected during the attack state, the key-off signal KOFF to remain at [0] when MASK signal is set to [1]. The AND-gate 614 outputs the logical product between the key-off signal KOFF and the GT signal.

The logic array, consisting of the AND-gate 615, AND-gate 616, OR-gate 617 and the AND-gate 618, is a logic circuit for setting the control signal CI (supplied to the half adder 601) to [0] when the STATE signal becomes [3] or [5]. This logic circuit is adopted to deal with a case, in which the key-depression state occurs over a long clock periods during the sustain state, by setting the output value of the AND-gate 618 at [0] even if the EQ signal becomes [1]. This logic is also operative for preventing the changing of an envelope state when the STATE signal is [5], i.e. the tone generation process is in the waiting state or in the release 2 state. The details of this processing will be explained later.

A logic circuit consisting of the AND-gates 619, 620 and OR-gate 621 operates to set the control signal CSA to [1] when STATE signal becomes either [3] or [5]. By so doing, the target envelope value S3 (refer to FIG. 5) is set to [1FFF(h)] during the sustain state or release 2 state.

The NOR-gate 630 outputs a control signal CSC which is the negative logical sum of the control signals CSA and CSB.

The inverter 622 outputs the inverted value of the SUSLVL signal to the AND-gate 624, and the inverter 623 outputs the inverted value of the SUSFLG to the AND-gate 629.

When the STATE signal is either [2] or [3] and the SUSLVL is [0], the output value of the AND-gate 624 becomes [1]. When the STATE signal is [3] and the SUSLVL is [1], the output value of the AND-gate 624 becomes [1]. The OR-gate 626 computes and outputs the logical sum of the AND-gate 624 and AND-gate 625.

The AND-gate 628 computes and outputs the logical product of the output value of the inverter 627, the output value of the OR-gate 626 and the key-off signal KOFF. Because the shift register 606 is supplied [100(b)] when the AND-gate 628 is [1], the function of the AND-gate 628 is to force the envelope state to be set to the release state.

The AND-gate 629 outputs the logical product between the output value of the inverter 627, key-off signal KOFF and the output value of the inverter 623 as a RR_SEL signal.

Section B Operation

B-4 Outline of the Operation of the Apparatus

The operational steps of the CPU 2 in the above described circuit configuration will be explained with reference to the flow charts presented in FIGS. 11 to 18.

Figure 11:
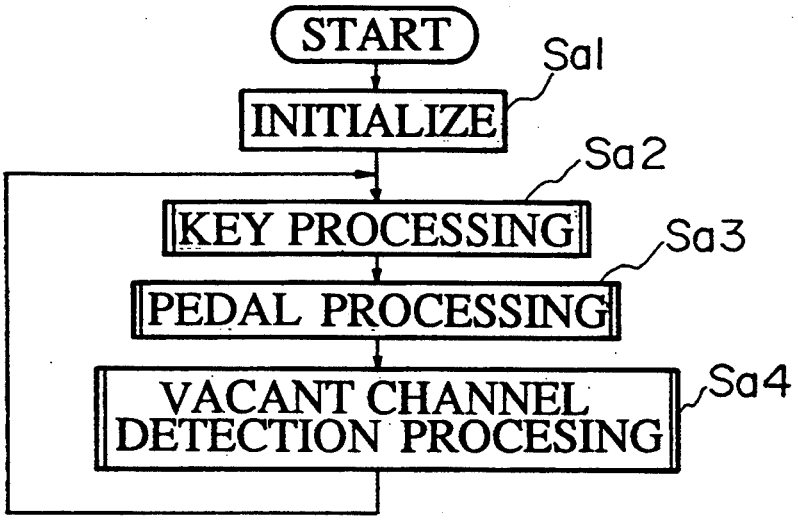
FIG. 11 is a flow chart for the main routine.

B-4-1 Main Routine (FIG. 11)

When the power to the electronic tone generation apparatus shown in FIG. 1 is turned on, the CPU 2 first performs the main routine shown in FIG. 11, and proceeds to the processing step Sa1 (step Sa1 hereinbelow), and performs initialization of the various sections, such as resetting the various registers to zero and setting the initial conditions in the peripheral circuits. In the envelope signal generation circuit ESG (FIG. 5), of the envelope signal generation circuit 13 (FIG. 2), the control signal LSA (FIG. 5) is set to [1], and a signal [1FFF(h)] is entered in the various sections of the envelope generation circuit, then CPU 2 proceeds to step Sa2. In the following, "it" refers to CPU 2.

In step Sa2, it examines the changes in the depress-/release condition of all the keys on the keyboard 1 through the keyboard interface 1*a*, and performs corresponding key-on or key-off operations in accordance with the changes, and proceeds to step Sa3.

In step Sa3, it examines the changes in the operational condition of the pedal 5, and performs corresponding pedal-on or pedal-off operation, and proceeds to step Sa4.

In step Sa4, it examines the changes in the condition of all the channels, and performs the vacant channel processing for those channels which have changed the state from in-use state to the vacant state.

When all these operations are completed, it returns to step Sa2, and it repeats the steps Sa2 to Sa4 until the power is turned off. Thus, in the main routine, CPU 2 forwards tone synthesis instructions (or designations) to the various operating sections in correspondence with the various states such as key depress/release conditions and pedal processing. The tone synthesis is performed by the various tone synthesis processing described later.

Figure 12:
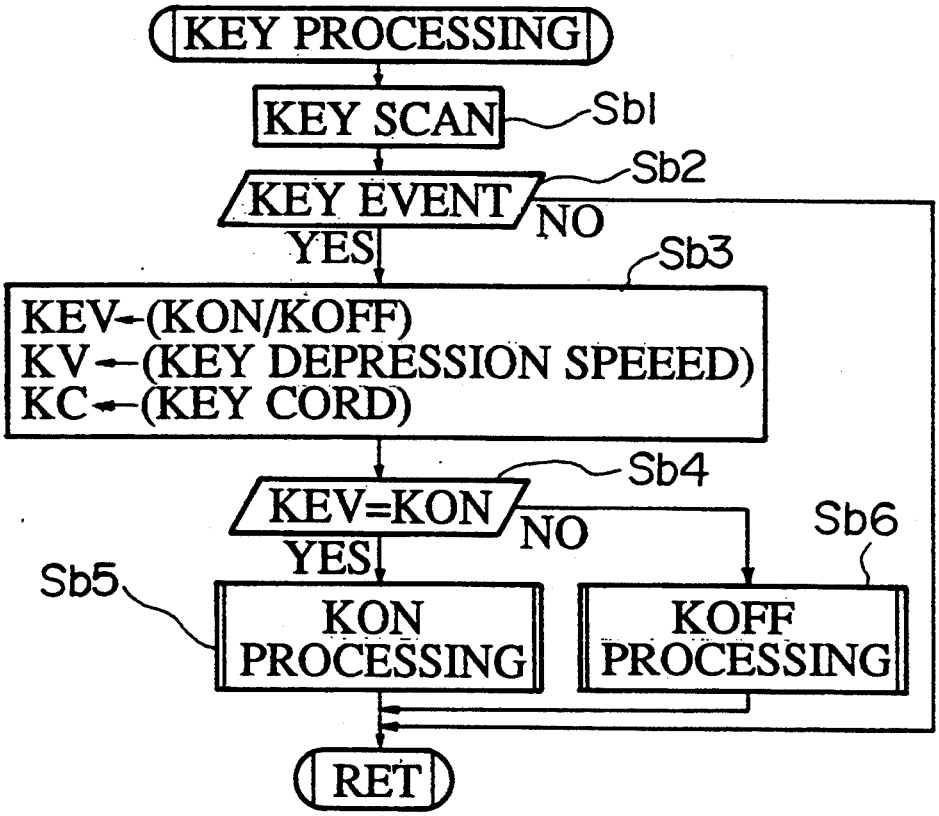
FIG. 12 is a flow chart for the key processing.

B-4-2 Key Processing Routine (FIG. 12)

In step Sb1, it scans the keyboard 1 for changes in the condition of key depress/release states through the keyboard interface 1*a*, and it proceeds to step Sb2.

In step Sb2, it decides whether changes in key depress/release states have taken place on the keyboard 1. If a change is not detected, and the decision is [NO], it returns to the main routine (FIG. 11).

If in step Sb2, a change in the key depress/release states is detected, and the decision is [YES], it proceeds to Sb3. In this case, for a key to change from a key-depress to a key-release, a judgement is made that a "Key Event" has occurred only when the key-off signal KOFF in FIG. 6 becomes [1].

In step Sb3, various tone information is entered into the various registers in accordance with the key depress/release states. In other words, key-on state or key-off state in the register KEV; key-release speeds in register KV; and key codes in KC. It then proceeds to step Sb4.

In step Sb4, it judges whether the values in the register KEV is key-on state or not. If the decision is [YES], key-on processing is performed in step Sb5, and it returns to the main routine. If the decision is [NO], it performs key-off processing in step Sb6, and returns to the main routine.

Figure 13:
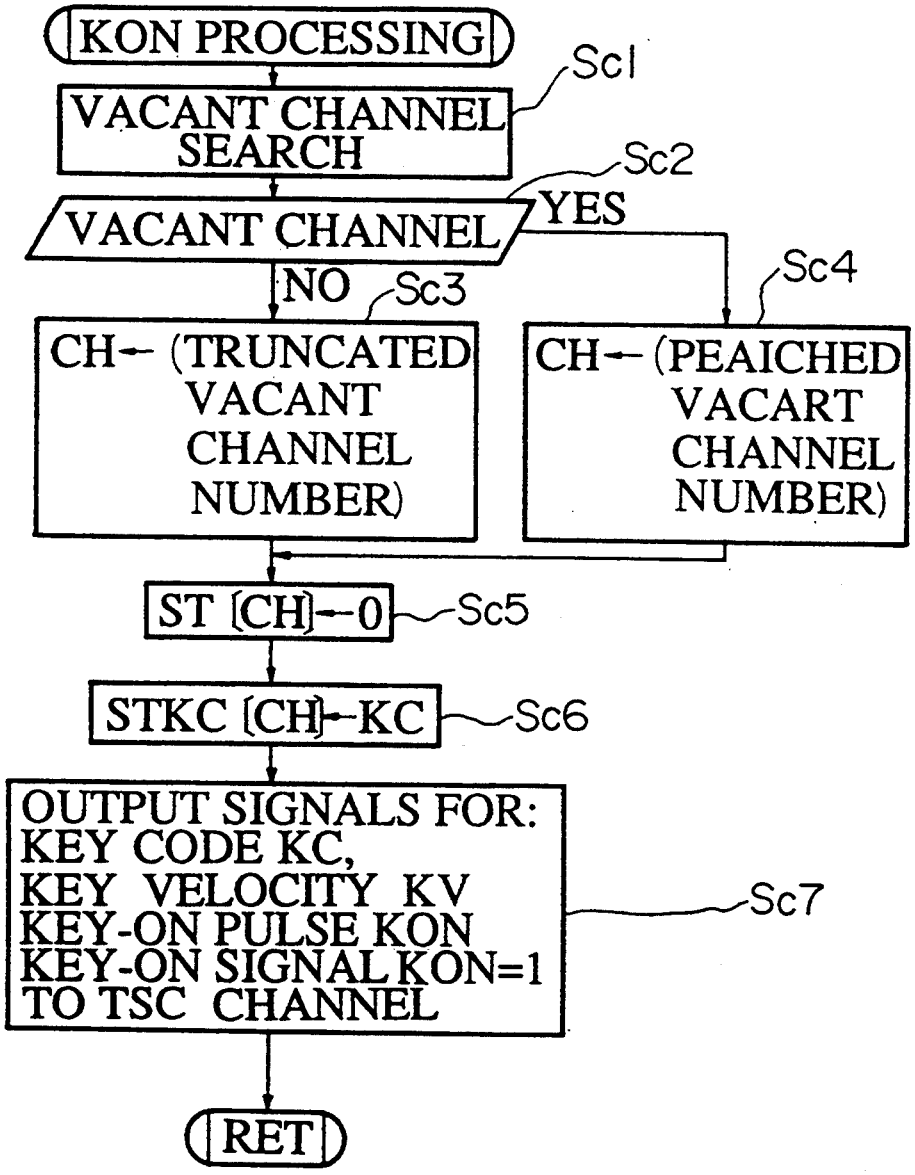
FIG. 13 is a flow chart for the KON processing.

B-4-3 Key-on Processing Subroutine (FIG. 13)

In step Sc1, it searches for a vacant channel which can accept a tone generation assignment.

In step Sc2, it judges whether there is a vacant tone generation channel. If there is no vacant channel, it proceeds to step Sc 3 and sets a vacant channel in the register CH by a truncation processing. In the meantime, if there is a vacant channel, it proceeds to step Sc4, and assigns its channel number to the register CH. It then proceeds to step Sc5.

In step Sc5, to indicate the attack state, it sets [0] in the register ST[CH] (where [CH.] represents a register CH in a channel) for representing the envelope state. At this time, since the key-on pulse KONP is [0], in FIG. 6, the STATE signal is [5].

In step Sc6, it sets the key code KC of the key subjected to key-on processing in the register STKC [CH] which stores the key codes to be generated.

In step Sc7, it outputs the detected key code KC and the key velocity KV to the tone generation channel number CH in the TSC 6. Also, the key-on pulse KONP for the corresponding tone generation channel is set to [1], and it sets the key-on signal to [1]. Thus, the control signal LSC is set to [1] (refer to FIG. 6), and the envelope signal starting value [L0] is loaded into the channel. The output signal from the inverter 607 is set to [0], and AND-gate 608, 609 and 610 become closed, and the STATE signal is set to [0], i.e. set to the attack state (refer to FIG. 6). The key-off signal KOFF is set to [0] (FIG. 6).

By following such steps, the envelope signal generation is started. The envelope signal takes the shapes shown in FIGS. 9 (*a*) to (*d*) depending on the subsequent states of the key-depression.

Figure 14:
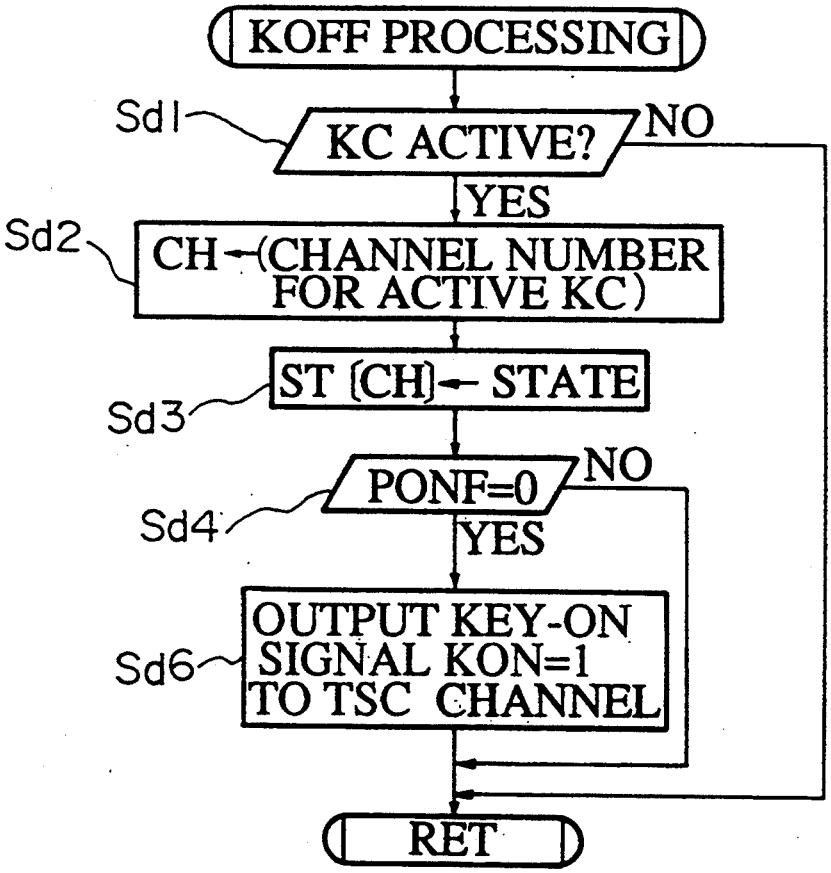
FIG. 14 is a flow chart for the KOFF processing.

B-4-4 Key-Off Processing Subroutine (FIG. 14)

In step Sd1, it judges whether a tone which corresponds to the key code KC in the key-release state is in the process of being generated. If the decision is [NO]. i.e. the tone is not being generated, the key-off processing is continued to completion, and it returns to the main routine (FIG. 11) via key processing Sa2 (FIG. 12). If the decision is [YES], i.e. the tone is being generated, it proceeds to step Sd2, and it assigns the tone generation channel number, of the key code KC of the key-off state, to the register CH and proceeds to step Sd3.

In step Sd3, it enters the value of the STATE signal which expresses the envelope state in the register ST[CH], and proceeds to step Sd4.

In step Sd4, it judges whether the pedal is on or not. If the decision is [YES], i.e. if the pedal is on, it proceeds to step Sd6, and it outputs a key-on signal [0], which indicates that the pedal is off, to the corresponding channel number CH of the TSC 6 (refer to FIG. 6). Here, in the envelope generation circuit ESG, in all the states, excepting the attack state, the envelope deceasing operations are carried out in accordance with the SUSFLG and SUSLVL signals, and in the attack state, if the value of the MASK signal is [0], the key-off signal is set to [1], and the envelope decreasing operations are carried out in accordance with SUSFLG and SUSLVL signals (refer to FIG. 6).

After performing step Sd6, it returns to the main routine (FIG. 11) through the key processing Sa2 (FIG. 12 ).

Figure 15:
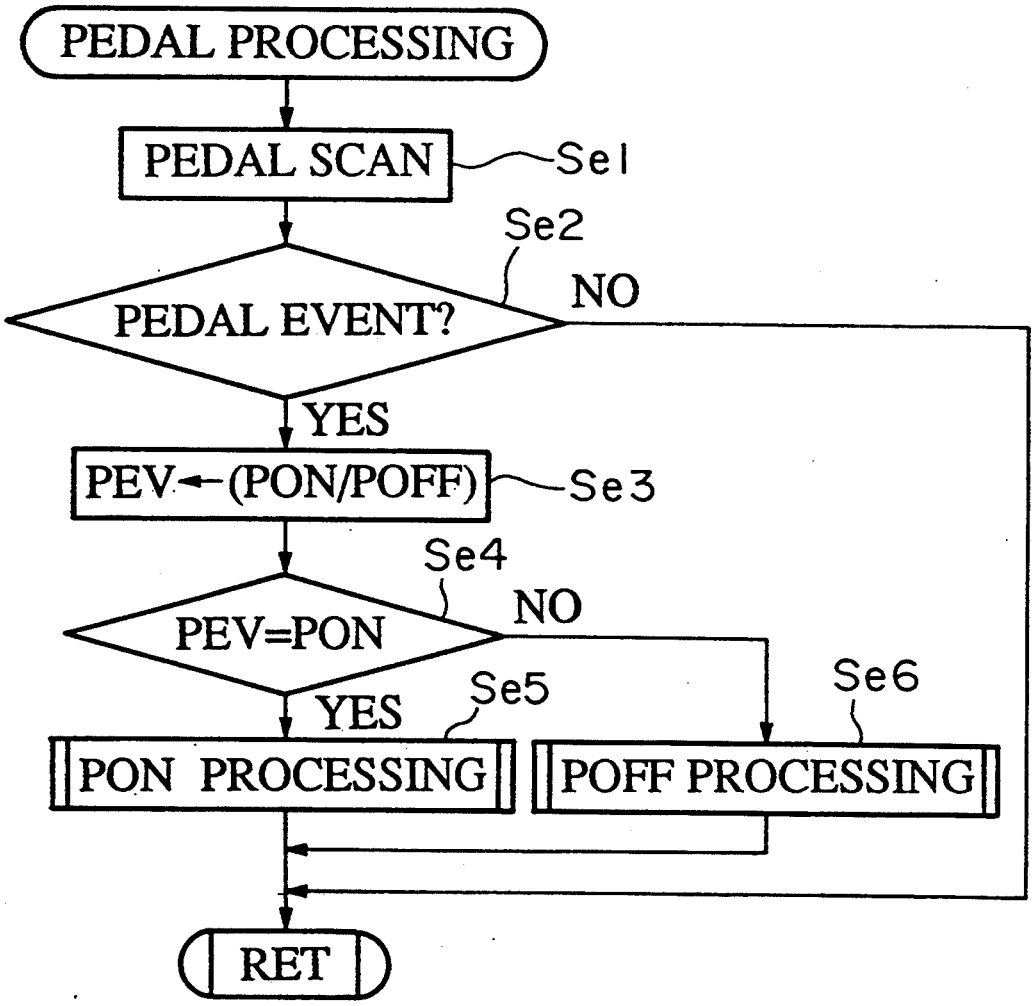
FIG. 15 is a flow chart for the pedal processing.

B-4-5 Pedal Processing Subroutine (FIG. 15)

The details of the pedal processing step Sa3 (refer to FIG. 11) will be explained next First, in step Se1, the pedal interface 5*a* examines the changes in the pedal operation state, and it then proceeds to step Se2.

In step Se2, it judges whether there has been a change in the pedal operation state. If there is no change, the pedal processing is completed immediately and returns to the main routine (FIG. 11).

If on the other hand, the decision is [YES], it proceeds to step Se3, it assigns a value to distinguish whether the pedal is being pressed or released. It then proceeds to step Se4.

In step Se4, it performs a branching operation depending on the value of the register PEV which stores pedal information. That is, if the register PEV indicates that the pedal is on, it proceeds to PON step Se5, and if the register PEV indicates that the pedal is off, it proceeds to POFF processing Se6, and begins a key off operation. As described, it proceeds to either Se5 or Se6, in accordance with the value of the register PEV, immediately completes the pedal processing, and returns the main routine (FIG. 11).

Figure 16:
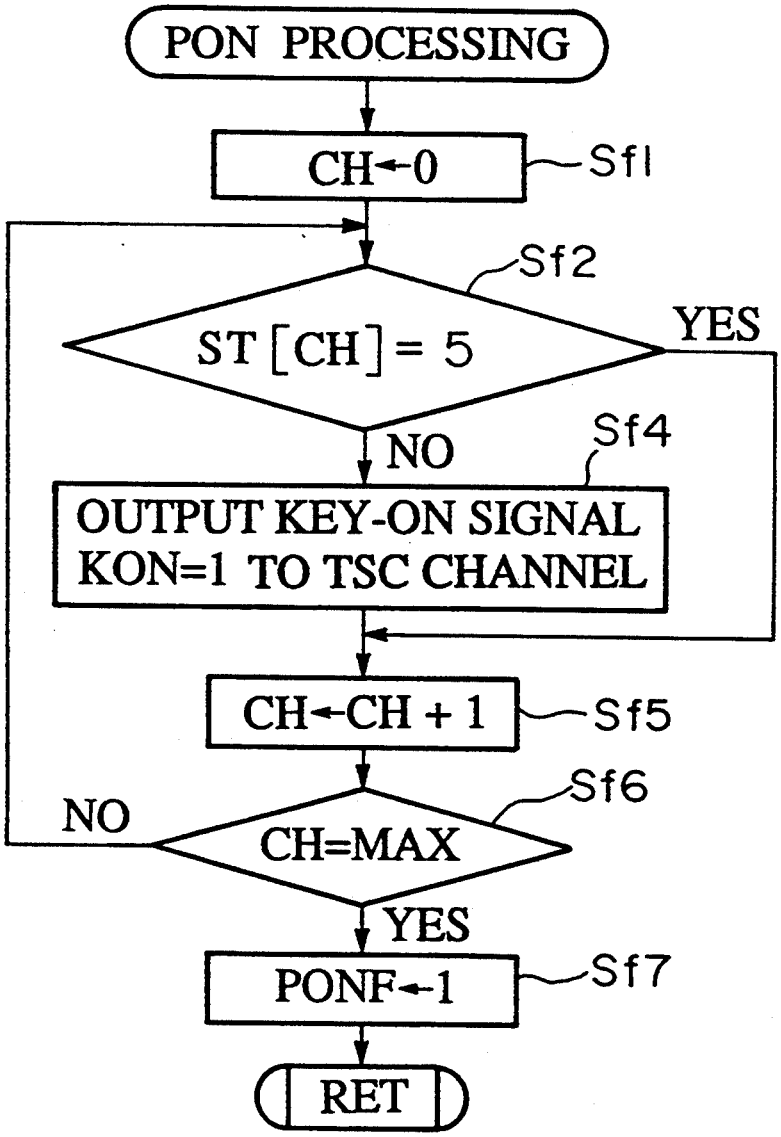
FIG. 16 is a flow chart for the PON processing.

B-4-6 PON Processing Subroutine (FIG. 16)

In step Sf1, it sets [0] in the channel number CH, and proceeds to step Sf2. In step Sf2, it judges whether or not the envelope state in the channel number CH is in the waiting state. If the decision is [NO], i.e. the tone generation state (one of the attack to release states), it proceeds to step Sf4, and sets the key-on signal KON to [1] in the channel number CH. Therefore, the key-on signal KON shown in FIG. 6 is set to [1], and within the envelope control signal generation circuit ECSG, the envelope decay operations are performed in accordance with the MASK signal, SUSFLG signal and SUSLVL signal.

After completing the processing in step Sf4, or if the decision in step Sf2 is [YES], it proceeds to step Sf5, and the channel number CH is incremented.

Next, it proceeds to step Sf6, and judges whether the value of the channel number is equal to a value MAX signifying the total number of available channels. If the decision is [NO], it returns to step Sf2, and repeats the above processing steps. Henceforth, it repeats the steps Sf2 to Sf5 Until the decision in step Sf6 becomes [YES]. In other words, the steps Sf2 to Sf5 are repeated for all the available channels. When the decision in step Sf6 becomes [YES], it proceeds to step Sf7, and sets [1] to the register PON, to signify that the pedal is on.

When the PON processing is completed, it returns to the main routine via the pedal processing (FIG. 15).

Figure 17:
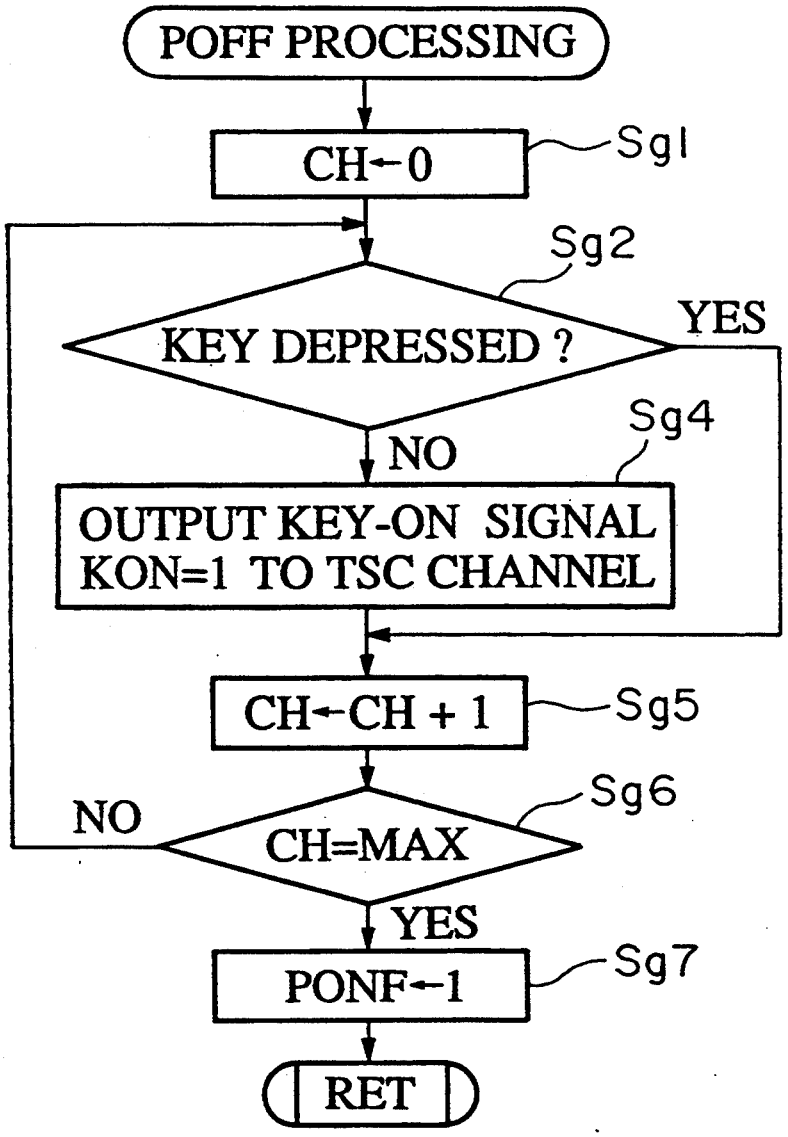
FIG. 17 is a flow chart for the POFF processing.

B-4-7 POFF Processing Subroutine (FIG. 17)

First, in step Sg1, it sets [0] to the register CH which signifies tone generation channel, then it proceeds to step Sg2.

In step Sg2, it examines whether a key corresponding to the tone generation channel is in the key-depression state. If the decision is [NO], i.e. the key is in the key-release state, it proceeds to step Sg4, it sets [0] to the key-on signal KON in the channel number CH in the TSC 6, to signify that the pedal is not on and that the key is in the key-release state. Therefore, the key-on signal KON in FIG. 6 is set to [0], and the envelope decay operation is performed in the envelope control signal generation circuit ECSG in accordance with the MASK signal and SUSFUL signal.

After the step Sg4 processing, or if the decision in step Sg2 is [YES], it proceeds to step Sg5, and it increments the channel number CH.

Next, it proceeds to step Sg6, and judges whether the value of the channel number is equal to a value MAX signifying the total number of available channels. If the decision is [NO], it returns to step Sg2, and repeats the above processing steps. Henceforth, it repeats the steps Sg2 to Sg5 until the decision in step Sg6 becomes [YES]. In other words, the steps Sg2 to Sg5 are repeated for all the available channels. When the decision in step Sg6 becomes [YES], it proceeds to step Sf7, and sets [0] to the register POFF, to signify that the pedal is off.

When the POFF processing is completed, it returns to the main routine via the pedal processing (FIG. 15).

B-4-8 Vacant Channel Detection Processing Subroutine

First, in step Sh1, it sets [0] to the channel number CH, it then proceeds to step Sh2, and judges whether or not the envelope state stored in the register [CH] is [5] (release 2 state). If the decision is [NO], i.e. in the tone generation state (one of the attack to release 1 states), it proceeds to step Sh3.

In step Sh3, it sets the value of the envelope signal ENV1 (refer to FIG. 2) in the register ENV[CH] which stores the envelope signal represented by the channel number CH.

Next, in step Sh4, it judges whether or not the value ENV[CH] is larger than the threshold level TH (tone generation limiting envelope value). If the decision is [YES], it proceeds to step Sh5, it sets [5] to the envelope state storage register ST[CH], i.e. to signify that the channel is in the waiting state.

After the completion of Sh4, or if the decision is [NO] in step Sh2 or Sh4, it proceeds to step Sh6, and increments the channel number CH, and proceeds to step Sh7.

In step Sh7, it judges whether or not the value of the channel number is the same as MAX which signifies the total available number of channels. If the decision is [NO], it returns to step Sh2, and repeats the above steps for all the channels. If the decision is [YES] in this step, the vacant channel processing is completed.

B-5 The Internal Operations of the Envelope Generation Circuit 13, and Their Relationship to the Flow Charts An outline of the internal operations of the envelope generation circuit 13 will be explained with reference to FIGS. 5 and 6.

B-5-1 Initializing Operation of Step Sa1 (FIG. 11)

When the initialize step Sa1 is operated, and the apparatus enters the waiting state, the values the STATE signal and the ST signal in the envelope control signal generation circuit ECSG shown in FIG. 6 become [5], and thus the control signal CSA becomes [1], the control signal CSB to [0] and the control signal CSC to [0]. This is because, since the STATE signal is [5], the AND-gate 619 output value becomes [1], and the AND-gate 620 output value becomes [0], thus making the output value of the OR-gate 621, which depends on these two input signals, to become [1]. The control signal LSC is [0].

Further, in the waiting state (more correctly, when ENV1>TH), the control signal LSA which is not shown, is set to [1]. As a result, [1IFFF(h)] is written into the various devices in the envelope signal generation circuit ESG (FIG. 5). In this case, because the control signal for the selector 15 is [1], it selects [1FFF(h)], supplied to the terminal A, as the output value and sets [1FFF(h)] in the envelope target value S3.

For the selector 18, because the control signal LSA is [1], it selects [1FFF(h)] supplied to the terminal A, as the output, and sets [1FFF(h)] in the envelope present signal S5, which is outputted to the shift register 19. The shift register 19 holds the signal [1FFF(h)] for one clock period, and returns it as the envelope signal ENV2 to the input terminals E of the comparator 16 and the adder 17.

Because the envelope signal ENV2 is looped by the shift register 19 as described above, when the various control signals shown in FIG. 6 are input into the circuit in the waiting state (when ENV1>TH), [1FFF(h)] is set in the various sections of the circuit shown in FIG. 5.

Also, the initial envelope value S4 outputted from the adder 17, and the EQ signal outputted from the comparator 16 becomes ineffective. This is because, the selector 18 selects the initial envelope value S4 to be entered to the terminal A, and the OR-gate 616 (FIG. 6) bars the EQ signal.

B-5-2 Circuit Operations of the Keyboard Interface 1*a* based on the Detection of Key-on Processing The operations of the circuit upon the detection of key-on state will be described in the following starting first with the case of the keyboard being played over a prolonged period of time.

B-5-2-1 When key-on pulse KONP becomes [1] by the key-on state detection

When a key-depression operation is detected by the keyboard interface la during the waiting period of the key-depression processing, the key-on pulse KONP shown in FIG. 6 becomes [1] for one clock period.

As a result, the control signal LSC becomes [1]. Also, because the inverter 607 inverts the signal [1] from the key-on pulse KONP and outputs the inverted value [0], the output values, T0, T1 and T2, of the AND-gates 608, 609 and 610 are forced to be [0]. Therefore, the STATE signal becomes [0], and the ST signal via the half adder 601 also becomes [0]. Thus, the selector 631 outputs LEVEL signal [L0] and Rate signal [R0].

Accordingly, the LEVEL signal in the envelope signal generation circuit ESG (FIG. 5) is loaded with [L0], and this value is set in the present envelope signal S4.

Also, the output value of the OR-gate 611 generated by the input value of the STATE signal, that is the control signal CSB becomes [1]. Therefore, the selector 15 (FIG. 5) sets [0000(h)] supplied to the input terminal B in the target envelope value S3. In this case, this [000(h)] is the target envelope value in the attack state. Next, because [0000(h)] supplied to the input terminal T is smaller than the signal value [1FFF(h)] of the present envelope value ENV2 supplied to the input terminal E, the comparator 16 outputs GT signal as [1] and EQ signal as [0].

Because the control signal LSC for the selector 18 is [1], the signal value [L0] of the LEVEL signal supplied to the input terminal C is chosen and set in the envelope signal ENV 3, and the value is outputted to the shift register 19. The shift register 19 holds [L0] for one clock period, and returns the signal as envelope signal ENV2 to the input terminals E of the comparator 16 and the adder 17. The initial envelope value S4 outputted from the adder 17, and the output value GT of the comparator 16 become ineffective. This is because the selector 18 selects the value of the initial envelope signal S4 to be supplied to the input terminal C, and because the key-off signal KOFF being [0] (FIG. 6) invalidates the GT signal.

The key-on signal becomes [1]. Therefore, the key-off signal KOFF is [0], and the control signal RR_SEL retains [0].

Further, the control signals CSA CSC and LSA which is not shown are all set to [0].

B-5-2-2 Attack State (Circuit Operations subsequent to key-on pulse KONP becoming [0])

Next, when the key-on pulse KONP becomes [0] after being held as [1] for one clock period, the values of the various signals are set as in the following.

First, the value [L0] of the LEVEL signal held in the shift register 19 is loaded into the adder 16, and the signal values, which was [101(b)], in the output terminal Q0 (lowest), Q1 (middle) and Q2 become [000(b)], and the envelope state becomes the attack state. As described, there is initially a time lag of one clock period in the values between the STATE signal at the time of the key-on state and the actual envelope, but for subsequent changes between the envelope state and the STATE signal are completely synchronous.

As a result, the control signal LSC become [0]. The other control signals CSA, CSB and CSC and the control signal LSA and LSC and the control signal RR_SEL all become [0] with the exception of the control signal CSB at [1]. Therefore, the control signal LSB (FIG. 5) becomes [1].

Here, the control signal is [1] is because the STATE signal is [0], i.e. the envelope state is in the attack state, therefore the output value of the NOR-gate 611 becomes [1] and correspondingly, the control signal CSB is kept at [1]. The control signal RR SEL is [0] because the key-on signal KON remains at [1], and because the key-off signal KOFF is [0].

The subsequent value of the key-on pulse KONP becomes [0], and it follows that all the subsequent control signal LSC become [0]. The control signal LSA which is not shown also becomes [0] for the subsequent period until the next key-depression processing waiting state. Until the next tone generation waiting state, the selector 18 selects the initial envelope signal S4 supplied to the input terminal B, and this value is outputted as the envelope signal ENV3.

Next, because the control signal CSB of the selector 15 shown in FIG. 5 is [1], the selector 15 selects [000(h)] supplied to the input terminal B, and outputs this value as the target envelope value S3. This [000(h)] is the target envelope value in the attack state. Next, the comparator 16 sets [1] in GT signal and [0] in EQ signal, and outputs the value to the adder 17.

Because the GT signal is [1], the adder 17 deducts the value of [R0] of the RATE signal supplied to the input terminal R from the present envelope value [L0] supplied to the input terminal E, and sets the resulting computed value [LO - R0] in the initial envelope signal S4 and outputs the value to the input terminal B of the selector 18.

Because the control signal LSB is [1], the selector 18 selects the value of the initial envelope signal S4, [L0-R0] to be supplied to the input terminal B, and sets this value in the envelope signal ENV3, and outputs the value to the shift register 19. The shift register 19 holds the signal [L0-RO] for one clock period, and outputs it as the envelope signal ENV2 and return it to the input terminals E of the comparator 16 and the adder 17.

When the key-on pulse KONP changes from [1] to [0], various signal values are set as described above.

The envelope signal ENV2 is looped in the envelope generation circuit ESG by the shift register 19. During the attack state, the GT signal value remains [1] so long as the value of the output EQ signal from the comparator 16, remains at [0]. It follows that, while the GT signal value is [1], the adder 17 continues to generate new initial envelope signal S4 by successively subtracting the signal value [R0] from the circulating signal value of the envelope signal ENV2. The initial envelope signal S4 returns to the adder 17 as a new present envelope signal value ENV2, to be decremented, via the selector 18 and the shift register 19.

As the decrement processing by the adder 17 is continued, the comparative result of the comparator 16 changes from [S3<ENV2] to [S3=ENV2].

B-5-2-3 Attack State (When EQ signal is [1])

As described above, when [S3=ENV2] is obtained, in FIG. 5, the output value of the comparator 16 changes from [0] to [1], and the GT signal changes from [1] to [0], and henceforth remains at [0].

Then, in FIG. 6, because the STATE signal is still [0], i.e. the attack state, the output values of the NAND-gates 615 and 616 are still [1]. However, because the EQ signal has changed to [1], the OR-gate 617 becomes [1]. Therefore, the output value of the AND-gate 618 becomes [1], and accordingly the control terminal CI of the half adder 601 changes from [0] to [1]. The half adder 601 adds [1] to the value of the STATE signal [0], and outputs the added result [1] from the output terminal S1 and S2, and sets ST signal to be [001(b)].

In response to the Change in the value of the ST signal to [001(b)], the selector 631 sets [L1] to the LEVEL signal and [R1] in the RATE signal, and outputs them respectively to the selector 15, the selector 18 and the adder 17 (Refer to FIGS. 5 and 6).

Because the operation is still in the attack state, the STATE signal is still [0], and the control signal CSB continues to be [1]. The other control signals CSA and CSC are [0].

Because the value of the GT signal is still [0], the adder 17 shown in FIG. 5 adds the signal value of the present envelope value ENV2 [0000(h)] supplied to the input terminal E to the value of the RATE signal [R1]newly supplied to the input terminal R, and sets the computed value in the initial envelope value S4, and output the value to the input terminal B of the selector 18.

Because the control signal LSB is [1], the selector 18 selects the signal value [R1] of the initial envelope signal S4 supplied to the input terminal B and set it in the envelope signal ENV3, and outputs the value to the shift register 19. The shift register 19 holds the value for one clock period, and returns the value to the input terminals E of the comparator 16 and the adder 17 as the envelope signal ENV2.

B-5-2-4 Circuit Operations in the Decay 1 State

When signal value [001(b)] stored in the ST signal of the shift register, shown in FIG. 6, is outputted from the output terminals Q0, Q1 and Q2, the STATE signal changes from [0] to [1], and the operation changes from the attack state to the decay 1 state.

As a result, because the output value of the NOR-gate 611 changes from [1] to [0], the control signal CSB changes from [1] to [0], thus becoming ineffective. Further, the output value of the OR-gate 621, in other words, the control signal CSA is still [0], the control signal CSC, instead of the control signal CSB, changes from [0] to [1], and becomes the effective signal.

Therefore, the selector 15 in FIG. 5 selects the value of the signal [L1] of the LEVEL signal supplied to the input terminal C, and outputs the value as the target envelope value S3 to the comparator 16. This [L1] is the target envelope value in the decay 1 state.

Next, the comparator 16 sets [0] in the GT signal and [0] in the EQ signal and outputs the values to the adder 17. Therefore the control terminal CI in the half adder 601 changes from [1] to [0].

Here, the signal value of the present envelope value ENV2 is [L1] so as to perform the changes from the attack state to the decay 1 state in both shift register 19 (FIG. 5) and the shift register 606 (FIG. 6) at the same time. In other words, the timing of the changing of the output signals from [0] to [1] in the envelope signal ENV from the shift register 19 and in the STATE signal from the shift register 606 to be identical (this was previously referred to as synchronous). Subsequently, this timing control is performed automatically in the case of transient states.

Because the GT signal is [0], the adder 17 adds the present envelope value [R1] supplied to the input terminal E and the RATE signal value [R1] supplied to the input terminal R, and sets the computed value [R1+R1]in the initial envelope signal ENV4, and supplies the value to the shift register 19, as the envelope signal ENV3, via the selector 18. The shift register 19 holds the value [R1+R1] for one clock period and returns the value to the input terminals E of the comparator 16 and the adder 17 as the envelope signal ENV2.

When the STATE signal changes from [0] to [1], i.e. changing from the attack state to the decay 1 state, various signals are set described above, and the envelope signal ENV2 is looped in the envelope signal generation circuit ESG by the shift register 19. In the decay 1 state, the GT signal remains at [0] so long as the EQ signal outputted by the comparator 16 is [0]. Therefore, while the GT signal is [0], the adder 17 continues to generate a new initial envelope signal S4 by successively adding the RATE signal [R1] to the looped envelope signal ENV2. The initial envelope signal S4 returns, as the new present envelope value ENV2, to the adder 17 via the selector 18 and the shift register 19, and receives the addition processing.

As the addition processing by the adder 17 is continued, the result of the comparator 16 changes from [S3 (=L1)>ENV2] to [S3 (=L1)=ENV2 ].

B-5-2-5 Decay 1 State (EQ signal is [1])

As described above, in FIG. 5, when [S3 (=L1)=ENV2] is achieved, the value of the EQ signal outputted from the comparator 16 changes from [0] to [1].

Accordingly, the OR-gate 617 becomes [1], thus changing the output value of the AND-gate 618, and the control terminal CI of the half adder 601 from [0] to [1] in response. The half adder 601 adds [1] to the value [1] of the STATE signal, and outputs the result [2] from the output terminals SO and S1, and sets the ST signal to [010(b)].

In response to the ST signal becoming [2], the selector 631 (FIG. 6) sets [L2] in the LEVEL signal and [R2] in the RATE signal, and outputs the value to the selector 15, selector 18 and the adder 17, respectively (FIG. 5).

Because the operation is in the decay 1 state, the STATE signal continues to be [1], and the control signal CSC continues to be [1]. The other control signals CSA and CSB are [0].

Because the value of the GT signal is [0], the adder 17 adds the signal value [L1] of the present envelope value ENV2 supplied to the input terminal E to the newly supplied [R2] of the RATE signal supplied to the input terminal R, and sets the computed value [L1+R2] in the initial envelope signal S4, and outputs the value to the input terminal B of the selector 18.

Because the control signal LSB is [1], the selector 18 selects the signal value [L1+R2] of the initial envelope signal S4 supplied to the input terminal B, and sets it in the envelope signal ENV3, and outputs the value to the shift register 19. The shift register holds the signal [L1+R2] for one clock period, and returns it as envelope signal ENV2 to the input terminals E of the comparator 16 and the adder 17.

B-5-2-6 Decay 2 State (when STATE signal is [2])

Next, when the values of the ST signal [010(b)] stored in the shift register 606 (FIG. 6) is outputted from the output terminals, Q0, Q1 and Q2, the STATE signal changes from [1] to [2], and the operation changes from the decay 1 state to the decay 2 state.

Then, the output value of the NOR-gate 611 remains unchanged at [0], so does the control signal CSB at [0]. Because the output value of the OR-gate 621, i.e. the control signal CSA is still [0], the control signal CSC remains at [1] and is effective.

Next, because the control signal CSC is [1], the selector 15 in FIG. 5 selects the signal value [L2] of the LEVEL signal supplied to the input terminal C, and sets it as the target envelope value S3, and outputs the value to the comparator 16. This value [L2] is the target envelope value during the decay 2 state.

Because the signal value [L2] of the target envelope value S3 supplied to the input terminal T of the comparator 16 is greater than the signal value [L1+R2] of the present envelope value ENV2 supplied to the input terminal E of the comparator 16 (refer to FIG. 7), it sets [0] in the GT signal and in the EQ signal, and outputs the value. Therefore, the control terminal CI of the half adder 601 changes from [1] to [0].

Next, because the signal value of the GT signal is [0], the adder 17 adds the present envelope value [L1+L2] suppled to the input terminal E to the signal value [R2] of the RATE signal supplied to the input terminal R, and sets the computed value [L1+R2+R2] in the initial envelope signal S4, and outputs the value, as the envelope signal ENV3 to the shift register 19 via the selector 18. The shift register 19 holds the value [L1+R2+R2] for one clock period, and outputs it as the envelope signal ENV2 to the input terminals E of the comparator 16 and the adder 17.

When the STATE signal change from [1] to [2], i.e. changes from the attack state to the decay 2 state, the various signals are set as described above, after which the envelope signal ENV2 is looped in the envelope signal generation circuit ESG by the shift register 19. In the decay 1 state, the GT signal remains at [0] while the EQ signal outputted by the comparator 16 remains at [0]. Therefore, the adder 17 continues to generate a new initial envelope signal S4, while the GT signal is [0], by successively adding the looped value, i.e. the initial envelope signal ENV2 and the value [R2] of the RATE signal. The initial envelope signal S4 returns to the adder 17 as a new present envelope value ENV2 via the selector 18 and the shift register 19 to be addition processed by the adder 17.

When the addition processing by the adder 17 is continued, the comparative result of the comparator 16 changes from [S3 (=L2)>ENV2] to [S3 (L=2)=ENV2].

B-5-2-7 Decay 2 State (when EQ signal is [1])

As described above, when [S3 (L=2)=ENV2] in FIG. 5, the output value of the EQ signal of the comparator 16 changes from [0] to [1].

As a result, the output value of the AND-gate 618 becomes [1], and in response, the control terminal CI of the half adder 601 changes from [0] to [1]. The half adder 601 adds [1] to the STATE signal [2], and outputs the added value [011(b)] from the output terminals SO and S1 and S2, and puts [3] in the ST signal.

In response to the ST signal becoming [3], the selector 631 sets [L4] in the LEVEL signal and [R3] in the RATE signal, and outputs the values to the selector 15, selector 18 and the adder 17, respectively (FIG. 5).

Here, because the operation is in the decay 2 state, the STATE signal remains at [2], the control signal CSC at [1]. Other control signals CSA and CSC are at [0].

Because the value of the GT signal is [0], the adder 17 adds the signal value [L2] of the present envelope value ENV2 supplied to the input terminal E and the new value [R3] of the RATE signal supplied to the input terminal R, and sets the computed value [L2+R3] in the original envelope signal S4, and outputs the value to the shift register 19 as the envelope signal ENV3 via the selector 18. The shift register holds the value [L2+R3] for one clock period, and returns the value as the envelope signal ENV2 to the input terminals E of the comparator 16 and the adder 17.

B-5-2-8 Sustain State

Next, when the values of the ST signal [3] stored in the shift register 606 (FIG. 6) is outputted from the output terminals, Q0, Q1 and Q2, the STATE signal changes from [2] to [3], and the operation changes from the decay 2 state to the sustain state. Then the output value of the AND-gate 620 becomes [1], and the value of the control signal CSA outputted by the OR-gate changes from [0] to [1].

Next, the selector 15 in FIG. 5 outputs [1FFF(h)] supplied to the input terminal A as the target envelope value S3. This value [1FFF(h)] is the target envelope value during the sustain state.

Because the signal value [1FFF(h)] of the target envelope value S3 supplied to the input terminal T of the comparator 16 is greater than the signal value [L2+R3] of the present envelope value ENV2 supplied to the input terminal E of the comparator 16 (refer to FIG. 7), it sets [0] in the GT signal and [0] in the EQ signal and outputs the value. Therefore, the control terminal CI of the half adder 601 changes from [1] to [0].

Next, because the signal value of the GT signal is [0], the adder 17 adds the present envelope value [L2+R3] supplied to the input terminal E to the signal value [R3] of the RATE signal supplied to the input terminal R, and sets the computed value [L2+R3+R3] in the initial envelope signal S4, and outputs the value, as the envelope signal ENV3 to the shift register 19 via the selector 18. The shift register 19 holds the value [L2+R3+R3] for one clock period, and outputs it as the envelope signal ENV2 to the input terminals E of the comparator 16 and the adder 17.

When the STATE signal changes from [2] to [3], i.e. changing from the decay 2 state to the sustain state, various signals are set as described above, and the envelope signal ENV2 is looped in the envelope signal generation circuit ESG by the shift register 19. In the sustain state, the GT signal remains at [0] so long as the EQ signal outputted by the comparator 16 is [0]. Therefore, while the GT signal is [0], the adder 17 continues to generate a new initial envelope signal S4 by successively adding the RATE signal [R3] to the looped envelope signal ENV2. The initial envelope signal S4 returns, as the new present envelope value ENV2, to the adder 17 via the selector 18 and the shift register 19, to receive the addition processing.

B-5-2-9 When Threshold Level TH becomes equal to Present Envelope Value ENV1 (FIG. 2) while the key-depression state is continued When the addition processing by the adder is continued as described above, the present envelope value ENV2 changes to [S3 (=1FFF)h)>TH=ENV1].

Then, the judging step Sh4 (FIG. 18) goes to [YES], and [5] is set in the register ST[CH], i.e. the release 2 state. At the same time, the control signal LSA supplied from the interface (not shown) becomes [1], and the control signal (not shown) initializes the loop circuit for generating the STATE signal by setting [101(b)], and the tone which had been generated is terminated.

In other words, when a key-depression state is continued over a prolonged period of time within a given tone generation channel, the sustain state is maintained until the present envelope value ENV1 becomes equal to the threshold level-TH. The sustain state is maintained unless the channel is needed for truncation processing during the key-depression state or pedal processing, or unless the pedal operation or key-release operation is detected.

B-5-3 Circuit Operations after Detection of Key-off Processing by the Keyboard Interface 1*a*

In the above description, circuit operations when the key-depression is continued over a prolonged period of time was described. In this section, circuit operations when the key-release processing is detected in the various envelope state with reference to FIGS. 9 and 10 will be explained. Explanations will also be made on the pedal operations based on the difference in the start-up timing between the actual key-release processing and the key-off signal KOFF.

FIGS. 9 (*a*) to (*d*) represent typical examples of the envelope waveforms which can occur when the key-release processing is detected. Each figure shows, respectively how the waveforms are changed when the key-off processing is detected during: (a) the attack state; (b) the decay 1 state; (c) the decay 2 state; and (d) the sustain state.

FIG. 10 shows the relationships between the envelope control signal values which control the waveform of the envelopes and the corresponding waveforms shown in FIGS. 9 (*a*) to (*d*). For example Curve 1, shown by a circled 1 in FIG. 9 (*a*), shows the waveform shape when the waveform control signals are set as shown in FIG. 10 (*a*), and likewise, Curve 2 to (b); Curve 3 to (c) and Curve 4 to (d) in FIG. 9. The stroke lines indicate "not applicable".

Also, the circuit operations are outlined for the cases of key-off processing detected during the attack, decay 1 and decay 2 sections, but the case of the key-off processing detected during the sustain state is explained in detail.

B-5-3-1 Detection of Key-release during the Attack State

When a key-release processing is detected during the attack state (refer to FIG. 9 (*a*) Curve 1), the envelope signals, which are decayed in accordance with the MASK signal and SUSFLG signal, are divided into: Curves 1, in which the envelope signal begins to decrease "immediately upon signal reception at the release rate"; and Curves 2, 3 and 4 in which the envelope signal begins to decrease "after the completion of the attack state in accordance with the SUSFLG signal and SUSLVL signal"

In the case of Curve 1, because the MASK signal is set to [0] as shown in FIG. 10, the key-on signal KON becomes [0] by the key-release processing, and the key-off signal KOFF becomes [1]. It should be noted that the SUSFLG is set to [0] in this case.

In the case of Curves 2, 3 and 4, because the MASK signal is set to [1] as shown in FIG. 10, the key-off signal KOFF becomes [1] after the decay 1 state. Of these curves, Curve 3 represents a case in which the SUSFLG is set to [1] and SUSLVL is set to [0]. Curve 4 represents a case in which the SUSFLG is set to [1] and SUSLVL is set to [1].

As explained above, when there is a difference between the actual key-release processing and the start-up of the key-off signal KOFF, and during which period if a pedal precessing is detected in step Se2 (FIG. 15), the key-on signal again becomes [1], and therefore, the envelope control is exercised as in the case of the key-release processing without shifting to the release state.

Also, as in the case of FIG. 9 (*a*) Curve 1, when the MASK signal is set to [0], as seen in FIG. 10, and when the SUSFLG is set to [1], the envelope signal becomes one of either Curves 2, 3 or 4.

B-5-3-2 Detection of Key-release Processing in Decay 1 State

When the key-release processing is detected during the decay 1 state (refer to FIG. 9 (*b*)), the envelope signals are divided, depending on the value of SUSFLG signal, into: Curve 1 in which the envelope signal begins to decrease immediately at the release rate; and Curves 2 and 3 in which the envelope signal is decreased at a rate dependent on the value of the SUSLVL signal, after the key-release processing is detected and the decay 1 state is completed.

In the case of FIG. 9 (*b*), Curve 1, when the key-release processing is detected, the key-on signal KON becomes [0], and the key-off signal KOFF becomes [1]. Also, because the SUSFLG signal is [0], the control signal RR_SEL becomes [1] immediately upon the key-release processing, and the envelope signal decreases at the release 1 rate.

In the case of Curves 2 and 3, because the SUSFLG signal is set to [1] in FIG. 10, the control signal RR_SEL does not become [1] as a result of key-release processing. Therefore, the envelope signal decreases at the release rate depending on the value of the SUSLVL signal. In this case, in Curve 2, the envelope signal decreases at the release rate from the time of the completion of decay 1 state, and in Curve 3, the envelope signal decreases at the release rate from the time of the completion of decay 2 state.

As described earlier, when there is a difference between the actual key-release processing and the start-up of the key-off signal KOFF, and when a pedal precessing is detected in step Se2 (FIG. 15), the key-on signal again becomes [1], and therefore, the envelope control is exercised as in the case of the key-release processing without shifting to the release state.

B-5-3-3 Detection of Key-release Processing during Decay 2 State

When the key-release processing is detected during the decay 2 state (refer to FIG. 9 (*c*)), the envelope signals are divided, according to the values of the SUSFLG signal into: Curve 1, in which the envelope signal decreases at the release rate immediately upon the detection of the key-release processing; and Curve 2 in which the envelope signal decreases, after the key-release processing is detected, and from the completion of the decay 2 state in accordance with the values of the SUSLVL signal.

In the case of FIG. 9 (*c*) Curve 1, because the key-on signal KON becomes [0] upon the detection of key-release processing, the key-off signal KOFF becomes [1]. Because the SUSFLG signal is [0], the control signal RR_SEL becomes [1] immediately upon the key-release processing, and the envelope signal decreases at the release 1 rate.

Also, even if the SUSFLG is set to [1], if the SUSLVL signal is set to [0], the envelope signal decreases as shown by Curve 1 in FIG. 9 (*c*).

Curve 2 represents a case of the SUSFLG signal at [1], and the SUSLVL signal is [1]. In this case, the envelope signal decreases at the release rate after the completion of the decay 2 state.

As described earlier, when there is a difference between the actual key-release processing and the start-up of the key-off signal KOFF, and when a pedal precessing is detected in step Se2 (FIG. 15), the key-on signal KON again becomes [1], and therefore, the envelope control is exercised as in the case of the key-release processing without shifting to the release state.

B-5-3-4 Detection of Key-release Processing during the Sustain State

B-5-3-4-1 Sustain State

The circuit operations performed when the key-release processing is detected during the sustain state will be explained in detail with reference to FIGS. 5 and 6.

After the present envelope value ENV2, shown in FIG. 5, reaches a signal value [L2] (after the EQ signal becomes [1]), suppose that the present envelope value ENV2 is looped for (n−1) times through the comparator 16 and the adder 17, then the present envelope value ENV2 becomes [L2+(n−1)R3], the target envelope value S3 becomes [1FFF(h)], the GT signal becomes [0], the EQ signal becomes [0], the initial envelope signal S4 and the envelope signal ENV3 become [L2+nR3].

When a key-release processing is detected, the key-on signal KON changes from [1] to [0]. Then, because the key-on signal KON and the output value of the NOR-gate 611 are at [0], the key-off signal KOFF changes from [0] to [1]. Also, because the STATE signal is [3], Q2 becomes [0] 0and the output value of the inverter 627 becomes [1].

The control of the subsequent envelope signals differs depending on the values of the SUSFLG and SUSLVL, so the following explanations are given for individual cases.

B-5-3-4-2 When SUSFLG is [0] (envelope control operates independent of the SUSLVL values)

Suppose the value of the SUSFLG signal is [0]. In this case, the AND-gate 629 outputs [1] generated by the logical product of the output value [1] of the inverter 627, the value [1] of the key-off signal KOFF and the inverted value [1] of the SUSFLG signal, as the control signal RR_SEL. Then, the value of the RATE signal is made to be [R4] by the selector 631. Therefore, the value [R4] of the RATE signal is inputted in the input terminal R of the adder 17 shown in FIG. 5. The next present envelope value ENV2 is looped back, and the processing advances by one clock period.

In response, the various signal values shown in FIG. 5 change as shown below. That is, the present envelope value ENV2 becomes [L2+nR3]. Because the value of the STATE signal is [3], the envelope state is in the sustain state, and the target envelope value S3 is [1FFF(h)]. The GT signal is [0], the EQ signal is [0], the initial envelope signal S4 and the envelope signal ENV3 are [L2+nR3+R4].

When the STATE signal is [3], the value of the OR-gate 626 becomes [1] regardless of the value of the SUSLVL signal. Therefore, the AND-gate 628 outputs [1] which is the logical product generated by the product of the output value [1] of the inverter 627, the output value [1] of the OR-gate 626 and the output value [1] of the key-off signal KOFF. It follows that the AND-gates 603 and 604 output the output value [1] of the inverter 602, and the OR-gate 605 outputs [1]. Therefore, the shift register 606 is made to store a signal value [4] for the next STATE signal.

Therefore, it means that the envelope signal decreases at the release rate from the time of the detection of the key-release processing. Also, if a pedal processing is later detected in step Se2, a tonal effect is provided by changing to the decreasing mode at the release rate.

B-5-3-4-3 When SUSFLG is [1]

Here, suppose the SUSFLG is [1]. Then, because the output value of the AND-gate 629 is [0], the control signal RR_SEL becomes [0]. However, because the output value of the AND-gate 628 becomes [1], [100(b)] is set in the ST signal, and in the selector 631, [L4] is set in the LEVEL signal and [R4] is set in the RATE signal.

In this case, various signals shown in FIG. 5 are determined as follows: the present envelope value ENV2 as [L2+nR3]; the target envelope value as [1FFF(h)]; the GT signal as [0]; EQ signal as [0]; the initial envelope value S4 and the envelope signal ENV3 as [L2+nR3+R4].

Therefore, it follows that the envelope signal decreases at the release rate from the time of the detection of the key-release processing. Also, if a pedal processing is later detected in step Se4, a tonal effect is provided by changing to the decreasing mode at the release rate.

B-5-3-4-4 Summary of Sustain State

As described above, in the sustain state, the envelope signal is decreased immediately in accordance with the actual key-release processing. Therefore, after a key-release processing is detected during the sustain state, even if the pedal processing is detected later and the key-on signal becomes [1], the envelope signal decreases at the release rate. Therefore, the envelope control is performed as in the release state.

B-5-3-5 Release 1 State

The circuit operations in the release 1 state presented above will be described below.

When the shift register 606 outputs a signal value [4] of the STATE signal, the envelope control enters the release 1 state, and the present envelope value ENV2 becomes [L2+nR3+R5].

In the release 1 state, the AND-gate 628 returns to [0] from [1], and the AND-gates 603 604 and the OR-gate 605 become inoperative.

The output value of the NOR-gate 611 becomes [0], and because both output values of the AND-gates 619 and 620 are set to [0], the output value of the OR-gate 621 becomes [0]. Therefore, the output value of the NOR-gate 630, i.e. the signal value of the control signal CSC changes to [1]. The control signal CSB changes from [1]to [0].

Regarding the target envelope value S3, the envelope state has changed to the release 1 state, thus the value is [L4]. Also, the GT signal is [0], the EQ signal is [0], and the initial envelope signal S4 and the envelope signal ENV3 becomes a signal value [L2+nR3+2R4].

When the STATE signal is [4] in the release 1 state, the various signals are set as described above, and the envelope signal ENV2 is looped by the shift register 19. During the release 1 state, the GT signal continues to remain at [0] so long as the EQ signal outputted by the comparator 16 remains at [0].

Therefore, the adder 17 renews the initial envelope signal S4 by successively adding the looped signal, i.e. envelope signal ENV2, to the value of the RATE signal [R4]. This initial envelope signal S4 is looped back as a new present envelope value ENV2 to the adder 17 for the addition processing.

When the addition processing by the adder 17 is continued, the comparative result of the comparator 16 changes from [S3 (=L4)>ENV2] to [S3 (=L4)=ENV2].

Then in FIG. 6, the STATE signal is still [4], i.e. in the release 1 state, the output values of the NAND-gates 615 and 616 are both [1]. Further, because the EQ signal has changed to [1], OR-gate 617 becomes [1]. Therefore, the output value of the AND-gate 618 becomes [1], and the control terminal CI of the half adder 601 changes from [0] to [1]. The half adder 601 adds [1] to the value [4] of the STATE signal, and outputs the computed value [5]from the output terminals S0, S1 and S2, and sets [101(b)] in the ST signal.

When the value of the ST signal becomes [5], the selector 631 sets [L0] (in this case, the target envelope value is given by another signal) to the LEVEL signal, and sets [5] to the RATE signal, and outputs the value to the selector 15 and the selector 18 and the adder 17, respectively (refer to FIG. 5).

The value of the RATE signal remains at [4], and the control signal CSC remains at [1]. Other control signals CSA and CSC are [0].

Next, because the value of the GT signal is [0], the adder 17 (FIG. 5) adds the value [L4] of the present envelope value ENV2 supplied to the input terminal E to the value [R5] of the RATE signal supplied to the input terminal R, and sets the computed value [L4+R5] in the initial envelope signal S4, and sets it in the envelope signal ENV3 via the selector 18, and outputs the value to the shift register 19. The shift register 19 holds the value [L4+R5] for one clock period, and returns the value to the input terminals E of the comparator 16 and the adder 17.

B-5-3-6 Release 2 State

When the key-release processing progresses one clock period, the signal value [101(b)] of the ST signal stored in the shift register 606 is outputted from the output terminals Q0, Q1, and Q2, and the signal value of the STATE signal changes from [4] to [5], and release 2 state begins.

At this time, the output value of the NOR-gate remains unchanged at [0], and the control signal CSB is [0]. However, the output value of the OR-gate 621, i.e. the control signal CSA, changes from [0] to [1]. This is because as the STATE signal becomes [5], the output value of the AND-gate 619 becomes [1].

Next, because the control signal CSA is [1], the selector 15 (FIG. 5) outputs the value [1FFF(h)], supplied to the input terminal A, as the target envelope value S3. This [1FFF(h)] is the envelope target value during the release 2 state. The reason for the value [1FFF(h)] to become the target envelope value is that, at this stage of the release 2 processing, because the key-release processing has already been detected, the remaining steps are to decrease the tone at the release rate, terminate the tone generation and enter the waiting state.

Next, because the value [1FFF(h)] of the target envelope value S3 supplied to the input terminal T of the comparator 16 is larger than the value [L4+R5] of the present envelope value ENV2 supplied to the input terminal E (refer to FIG. 7), the comparator 16 sets [0] to the GT and EQ signals, and outputs the value. Therefore, the control terminal CI of the half adder 601 changes from [1] to [0].

Next, because the signal value of the GT signal is [0], the adder 17 adds the present envelope value [L4+R5] supplied to the input terminal E to the value [R5] of the RATE signal supplied to the input terminal R, and sets the computed result [L4+2R5] in the initial envelope signal S4, and outputs the value as the envelope signal ENV3 to the shift register 19 via the selector 18. The shift register 19 holds the value [L4+2R5] for one clock period, and returns the value as the envelope signal ENV2 to the input terminals E of the comparator 16 and the adder 17.

When the STATE signal is changed to the release 2 state, the various signals are set as described above, and the envelope Signal ENV2 is looped in the envelope signal generation circuit ESG by the shift register 19. During the sustain state, the GT signal remains at [0] as long as the EQ signal is at [0]. It follows that while the GT signal is [0], the adder 17 continues to generate a new initial envelope signal S4 by successively adding the RATE signal [R5] to the looped envelope signal ENV2. The initial envelope signal S4 returns, as the new present envelope value ENV2, to the adder 17 via the selector 18 and the shift register 19, and receives the addition processing.

Figure 18:
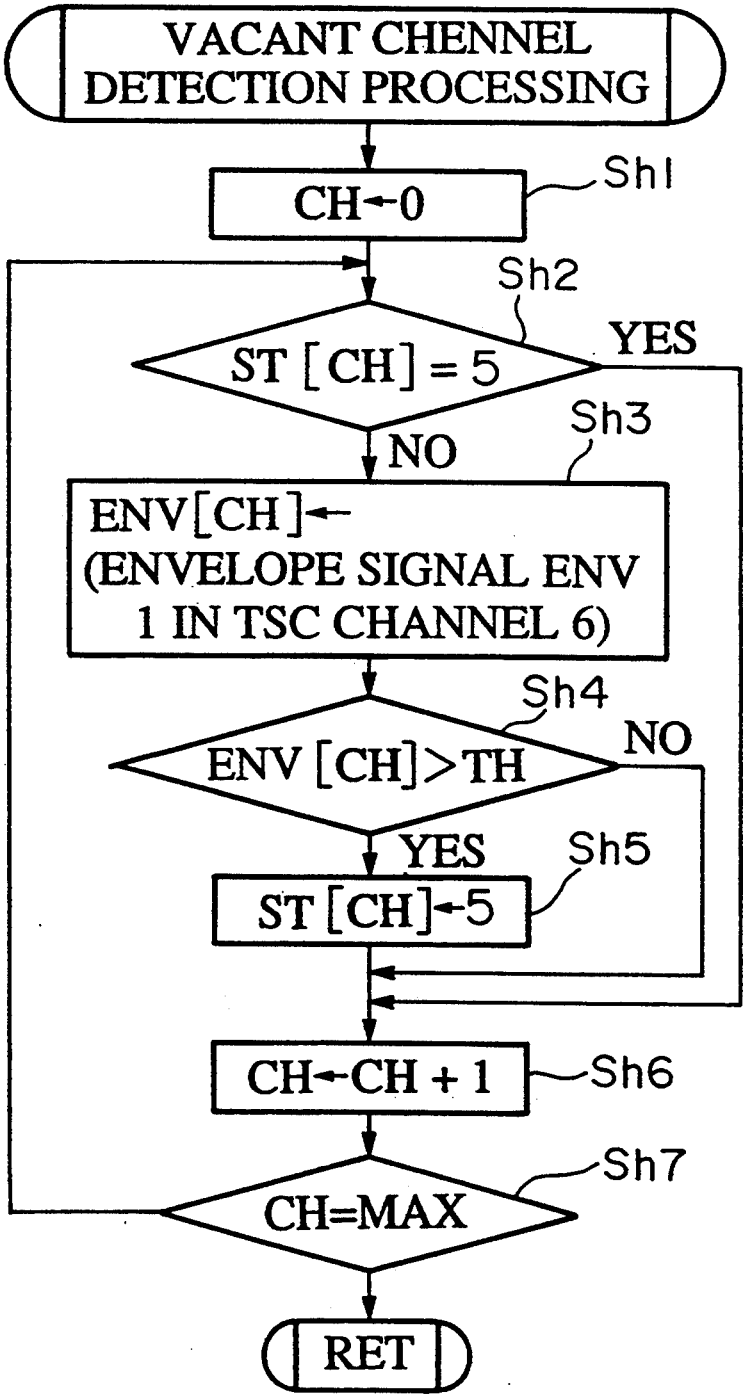
FIG. 18 is a flow chart for the vacant channel detection processing.

When the above addition processing by the adder 17 is continued, the signal value of the initial envelope signal S4 gradually approaches [1FFF(h)], and the signal value of the envelope signal ENV1 approaches the threshold level TH in step Sh4 shown in FIG. 18. When the CPU 2 detects that the signal value of the envelope signal ENV1 exceeded the threshold value TH, it forces the initialization of the corresponding tone generation channel, and sets the control signal LSA to [1], and prepares for the waiting state.

C Variations and Modifications

In the above described embodiments, key-on signal KON was used to direct the process of tone generation, and the tone termination was effected by the key-off signal KOFF. In this case, the tone generation signal becomes immediately [1] (operative), but the tone termination signal becomes [1] and operative under the following conditions. That is, under the condition that the SUSFLG signal is [1], if a key-release processing is detected during the decay state, it is possible to delay the on-[1] timing (for initiating [1]) for the key-off signal KOFF and modify the envelope shape, by controlling the SUSLVL signal. Furthermore, when the MASK signal is [1], if a key-release processing is detected during the attack state under the above condition, it is also possible to delay the on-[1] timing for the key-off signal KOFF.

Therefore, the tone generation/termination designations or instructions can be provided by other methods. For example, a wind controller may be utilized. Also in the above embodiments, the pedal was used to control the continuation of tone generation processing, but other methods can also be effective. For example, a portamento switch can be utilized.

Further, in the above embodiments, the circuit is designed to continually supply STATE signals to the central processing unit CPU 2 from the tone synthesis circuit TSC 6, so that the CPU 2 controls the STATE signals of the tone envelopes of each of the tone generation channels. In other words, the CPU 2 controls the detailed processing steps of the waveform generation process in the tone generation circuit TSC 6.

What is claimed is:

1. An electronic musical tone synthesizing apparatus for generating musical tones to each of which an envelope waveform is imparted, comprising:

a plurality of tone generation channels, each for generating a musical tone;

a plurality of tone termination designating means for designating termination of the production of at least one of said musical tones respectively produced by said tone generation channels;

tone continuation means for designating continuation of the generation of at least one of said musical tones;

envelope generation means for generating envelope signals corresponding to said envelope waveforms, wherein each of said respective envelope signals decreases at a first rate in response to said tone termination designating means, and when said tone continuation means is operated after at least one of said tone termination designating means is operated, said envelope signals corresponding to the musical tones designated by said at least one tone termination designating means which has been operated decreases at a second rate in response to said tone continuation means, said second rate being smaller than said first rate.

2. An apparatus as claimed in claim 1 further comprising signal controlling means for generating a target value of an envelope waveform in accordance with the duration of time between the start of a tone generation process to the end of said tone generation process of said musical tone in a given envelope state, said first rate and said second rate being determined by said target value.

3. An apparatus as claimed in claim 2 further comprising envelope detection means which detects the maximum amplitude level of a musical tone generated, wherein said signal controlling means forces a vacating of a tone generation channel having the lowest amplitude level so as to generate a vacant channel in preparation for the generation of an another musical tone, and assigns said another musical tone to said vacant channel.

4. An apparatus as claimed in claim 1, wherein said tone continuation means comprises a foot pedal, and wherein continuation of generation of said musical tones is designated by pressing on said foot pedal.

5. An apparatus as claimed in claim 1, wherein said tone continuation means comprises a portamento switch, and wherein continuation of generation of said musical tones is designated by operating said portamento switch.

6. An apparatus as claimed in claim 1 further comprising signal controlling means for generating a change rate of an envelope waveform in accordance with the duration of time between the start of a tone generation process to the end of the tone generation process of a musical tone in a given envelope state, said first rate and said second rate being determined by said change rate.

7. An electronic musical tone synthesizing apparatus for generating at least one musical tone to which an envelope waveform is imparted comprising:

a plurality of tone generation channels, each for generating a musical tone;

a plurality of tone termination designating means, each for designating termination of the production of a musical tone;

tone continuation designating means for designating continuation of the generation of at least one of said musical tones;

an envelope generator for generating and imparting an envelope to envelope waveforms, wherein:

when termination of production of said a musical tone is designated by the tone termination designating means, the envelope generator imparts a decay envelope to the corresponding envelope waveform; and when the tone continuation designating means designates continuation of said at least one musical tone after said tone termination designation means is operated, the envelope generator decreases the decay rate of the decay envelopes corresponding to the musical tones designated by the tone termination designating means.

8. An apparatus as claimed in claim 7 wherein one of the tone termination designating means controls termination of production of the musical tone in a respective one of the tone generation channels.

9. An apparatus as claimed in claim 7 wherein when the tone continuation designating means is operated after any one of said tone termination designating means is operated, the envelope generator decreases the decay rate of the decay envelope of the musical tone generated by the tone generation channel corresponding to the tone termination designating means which have been operated.

10. An apparatus as claimed in claim 7 wherein each of the tone termination designating means comprises a key device having a depressed and a released position and the termination of production of said musical tone is designated by allowing the key to move to the released position.

11. An apparatus as claimed in claim 7 wherein the tone continuation designating means comprises a damper pedal having a depressed and a released position and the tone continuation designating means is operated to designate continuation of a musical tone by depressing the damper pedal.

12. An apparatus as claimed in claim 7 wherein the tone continuation designating means comprises a portamento switch having an engaged and a disengaged position and the tone continuation designating means is operated to designate continuation of the musical tone by moving the portamento switch to the engaged position.

13. An apparatus as claimed in claim 7 wherein the envelope generator is a digital envelope generator.

* * * * *